US011674737B2

(12) United States Patent
Kim et al.

(10) Patent No.: US 11,674,737 B2
(45) **Date of Patent: *Jun. 13, 2023**

(54) REFRIGERATOR WITH MECHANISM FOR INSTALLING IN A STORAGE SPACE

(71) Applicant: LG ELECTRONICS INC., Seoul (KR)

(72) Inventors: Yongnam Kim, Seoul (KR); Minkyu Oh, Seoul (KR); Yanghwan No, Seoul (KR); Seongwoo An, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/326,823

(22) Filed: May 21, 2021

(65) Prior Publication Data

US 2021/0278123 A1 Sep. 9, 2021

Related U.S. Application Data

(63) Continuation of application No. 16/523,885, filed on Jul. 26, 2019, now Pat. No. 11,035,604.

(30) Foreign Application Priority Data

Aug. 16, 2018 (KR) ..... 10-2018-0095588

(51) Int. Cl.
*F25D 17/08* (2006.01)
*F25D 23/10* (2006.01)

(52) U.S. Cl.
CPC ..... *F25D 17/08* (2013.01); *F25D 23/10* (2013.01); *F25D 2317/063* (2013.01); *F25D 2317/0654* (2013.01); *F25D 2317/0661* (2013.01); *F25D 2317/0665* (2013.01); *F25D 2317/0672* (2013.01)

(58) Field of Classification Search
CPC ..... F25D 23/10; F25D 19/00; F25D 2400/32; F25D 17/08; F25D 2317/063; F25D 2317/0654; F25D 2317/0661; F25D 2317/0665; F25D 2317/0672; A47L 15/4251; A47L 15/4209; A47L 15/427; Y10T 292/71; Y10T 292/0834; Y10T 292/084; Y10T 292/096; Y10T 292/1016
USPC ..... 62/261
See application file for complete search history.

(56) References Cited

U.S. PATENT DOCUMENTS

| | | | | |
|---|---|---|---|---|
| 5,505,046 A | 4/1996 | Nelson | F25B 21/02 62/3.6 |
| 5,522,216 A * | 6/1996 | Park | F25D 19/00 62/3.6 |
| 2008/0272267 A1 | 11/2008 | Kristensson | A47L 15/427 248/675 |

FOREIGN PATENT DOCUMENTS

| | | | | |
|---|---|---|---|---|
| CN | 106679285 A | | 5/2017 | |
| CN | 1079606810 | * | 4/2018 | F25D 23/10 |
| DE | 102009014552 A1 | | 9/2010 | |
| DE | 102012207684 A1 | | 11/2013 | |

(Continued)

OTHER PUBLICATIONS

Definition if lever, Merriam-Webster, https://www.merriam-webster.com/dictionary/lever, retrieved from internet Jun. 9, 2022 (Year: 2022).*

*Primary Examiner* — Cassey D Bauer
(74) *Attorney, Agent, or Firm* — Dentons US LLP

(57) ABSTRACT

A refrigerator to be installed in a storage space defined by a wall of an object includes a contact mechanism so that the refrigerator makes contact with the wall, and thus the refrigerator can be installed.

15 Claims, 32 Drawing Sheets

(56) References Cited

FOREIGN PATENT DOCUMENTS

| | | | |
|---|---|---|---|
| JP | 2003161565 | A | 6/2003 |
| KR | 10-0569935 | B1 | 4/2006 |
| KR | 10-0828337 | BI | 5/2008 |
| KR | 20170047204 | A | 5/2017 |

* cited by examiner

REFRIGERATOR WITH MECHANISM FOR INSTALLING IN A STORAGE SPACE

CROSS-REFERENCE TO RELATED APPLICATIONS

This application is a continuation of U.S. patent application Ser. No. 16/523,885 filed on Jul. 26, 2019, which claims priority under 35 U.S.C. 119 and 35 U.S.C. 365 to Korean Patent Application No. 10-2018-0095588 (filed on Aug. 16, 2018), which is hereby incorporated by reference in its entirety.

BACKGROUND

The present disclosure relates to a refrigerator which may be driven with low noise by using a thermoelectric device.

A thermoelectric device refers to a device that implements heat absorption and heat generation using a Peltier effect. The Peltier effect refers to an effect of causing an endothermic phenomenon on one side surface of the thermoelectric device and an exothermic phenomenon on an other side surface thereof according to a direction of the current when a voltage is applied to both ends of the thermoelectric device. This thermoelectric device may be used in a refrigerator instead of a freezing cycle device.

Generally, a refrigerator is an apparatus which stores food for a long period of time without spoiling by forming a food storage space capable of blocking heat from the outside by a cabinet and a door filled with insulation material therein, providing a freezing device including an evaporator for absorbing heat inside the food storage space and a heat dissipating device for discharging the absorbed heat to the outside of the food storage space, and keeping the food storage space at a temperature region having a low temperature where microorganisms cannot survive and proliferate.

The refrigerator may be formed in a state of being divided into a refrigerating chamber for storing food in a temperature region of above zero (0) degree celsius and a freezing chamber for storing food in a temperature region of below zero degree celsius, and, according to a disposition of the refrigerating chamber and the freezing chamber, divides into a top freezer refrigerator which has an upper freezing chamber and a lower refrigerating chamber, a bottom freezer refrigerator which has a lower freezing chamber and an upper refrigerating chamber, a side by side refrigerator which has a left freezing chamber and a right refrigerating chamber or the like.

In addition, the refrigerator has a plurality of shelves, a plurality of drawers, and the like in the food storage space so that the user may conveniently store or draw out food in the food storage space.

Meanwhile, a built-in refrigerator refers to a refrigerator that, for example, has been embedded in furniture, walls, or the like when the building is first built. While general refrigerators are installed in opened spaces, the built-in refrigerators may be embedded in furniture, walls, or the like. Therefore, the built-in refrigerator may be more vulnerable to heat dissipation than the general refrigerator.

The Applicant has filed a patent application in the Republic of Korea, which has been registered as follows, with respect to a built-in refrigerator.

1. Registration patent number (Registration date): No. 10-0569935 (Apr. 4, 2006)

2. Title of invention: Heat-dissipating structure of built-in refrigerator

According to the patent document, air is sucked through a bottom surface of the refrigerator in a machine chamber, and the air is again discharged to a rear of the refrigerator. Air discharged to the rear of the refrigerator is raised by natural convection.

However, since the machine chamber is generally installed at the lower end of the refrigerator, the hot air discharged to the rear of the refrigerator may affect the entire rear surface of the refrigerator. The air rising due to natural convection constantly meets the entire area of the rear of the refrigerator. This may adversely affect the insulation load and performance required in the refrigerator.

In addition, the air discharged to the rear of the refrigerator may not rise and may be sucked back into the machine chamber. Especially, in a case where the left and right side surfaces of the refrigerator are shielded as in a built-in refrigerator, there is a high possibility that the hot air may be sucked back into the machine chamber.

In addition, there is a problem that loud noise may be generated in the refrigerator due to the driving of the compressor.

Moreover, there is a problem that the refrigerator may not be stably installed in the built-in furniture.

SUMMARY OF THE DISCLOSURE

So as to solve the problem, one aspect is to provide a compact built-in refrigerator which is capable of reducing noise. In particular, one aspect is to provide a refrigerator having a structure in which a storage chamber is cooled by a thermoelectric device module and a heat dissipating flow is formed by using a fan provided in the thermoelectric device module.

In addition, one aspect is to provide a refrigerator which can easily cool a stored product stored close to a side of a door by extending a supply duct for supplying cool air to the storage chamber from the rear wall of the cabinet toward the side of the door to be lengthened to the front.

In addition, one aspect is to provide a refrigerator which can keep the temperature of the storage chamber low, even if the refrigerator is moved from the built-in-place thereof to another place so that the stored product of the refrigerator is not damaged during the moving process. In particular, one aspect is to provide a refrigerator in which a cold storage agent is disposed in the supply duct, and thus the temperature of the storage chamber can be kept low even if cool air is not supplied through the duct when the refrigerator is moved.

In addition, one aspect is to provide a refrigerator which can easily cool the storage chamber by heat-exchanging the cool air in the storage chamber with the endothermic heat sink of the thermoelectric device module and supplying the heat exchanged cool air to the storage chamber through the cool air circulation fan. In particular, the cool air circulation fan is provided on the rear wall of the cabinet and the cool air passing through the cool air circulation fan is supplied from the rear wall, the upper portion, and lower portion of the cabinet to the storage chamber, and thus the cool air can be effectively supplied.

In addition, one aspect is to provide a refrigerator which can easily dissipate the heat of a refrigerator by providing an outdoor air circulation fan for forcibly introducing and discharging the outdoor air. In particular, one aspect is to provide a refrigerator which can facilitate heat exchange with an exothermal heat sink of a thermoelectric device module by disposing a heat dissipating duct in outer space of the storage chamber to circulate the outdoor air.

In addition, one aspect is to provide a refrigerator which enables a built-in refrigerator to be stably installed by the built-in refrigerator being in compact with a relative object (for example, furniture, or the like).

A refrigerator according to the embodiments of the present invention may be a refrigerator to be installed in a storage space defined by a wall of an object and includes a contact mechanism configured to bring the refrigerator into contact with the wall, so that the refrigerator can be stably installed.

The refrigerator further includes a cabinet having an inner case forming a storage chamber, an outer case surrounding the inner case, and a cabinet insulation material disposed between the inner case and the outer case; and a door disposed in front of the cabinet, the door being configured to open and close the storage chamber.

The refrigerator further includes a supply duct installed in the inner case, the supply duct being configured to discharge cool air to the storage chamber; and a cool air circulation fan installed at one side of the supply duct, the cool air circulation fan being configured to generate circulation of the cool air, so that the cool air can be smoothly circulated.

The refrigerator includes a heat dissipating duct installed in the cabinet insulation material, the heat dissipating duct being configured to introduce or discharge outdoor air; and a heat dissipating fan installed at one side of the heat dissipating duct, the heat dissipating fan being configured to generate a flow of the outdoor air, so that the outdoor air can be smoothly circulated.

The contact mechanism is disposed on the upper side of the cabinet so that the user can easily operate the lever.

The housing includes a housing front portion and a housing side portion extending rearward from both sides of the housing front portion, and the insertion portion may be formed on the housing side portion.

The housing further includes a housing upper portion connected to the housing side portion, and the lever is disposed on the upper portion of the housing so that the user can easily access the lever.

The side surface of the guide plate extends obliquely in the front and rear direction, and the contact member can move along the side surface of the guide plate.

The contact member may include a member side portion extending obliquely in the front and rear direction.

The contact member includes a first contact member disposed on one side surface of the guide plate; and a second contact member disposed on the other side surface of the guide plate so that the contact of the refrigerator can be easily performed.

The contact mechanism further includes an engaging member provided on the guide plate and a rack engaged with the engaging member.

The engaging member is rotatably coupled to the guide plate.

The contact mechanism further includes a torsion spring coupled to the engaging member and the lever.

The contact mechanism may be installed inside the outer case.

The contact mechanism may further include a plate elastic member for providing a restoring force to the guide plate.

The plate elastic member is coupled to the guide plate and the housing.

The contact mechanism further includes a stopper mechanism for restricting the movement of the lever, and the stopper mechanism includes a ball and a ball spring coupled to the ball to provide a restoring force.

The contact mechanism further includes a lever support which is provided on both sides of the lever to guide the movement of the lever; and an engaging groove which is recessed in the lever support and into which at least a portion of the ball is inserted.

The housing is provided with a handle.

According to the description above, the generation of cool air and heat dissipation can be performed using the thermoelectric device module, so that noise generated in the refrigerator can be reduced.

In addition, since the supply duct for supplying cool air to the storage chamber can be extended from the rear wall of the cabinet toward the side of the door to be lengthened to the front side and thus can be positioned to be close to the side of the door so that the storage chamber can be cooled evenly.

In addition, by disposing the cold storage agent in the supply duct, the temperature of the storage chamber can be kept low even if the cool air is not supplied from the duct when the refrigerator is moved.

In addition, the cooling air in the storage chamber exchanges heat with the endothermic heat sink of the thermoelectric device module, and the heat exchanged cool air is supplied to the storage chamber through the cool air circulation fan so that the storage chamber can be easily cooled. In particular, the cool air circulation fan is provided on the rear wall of the cabinet, and the cool air passing through the cool air circulation fan is supplied from the rear wall, the upper portion, and lower portion of the cabinet to the storage chamber, and the cool air can be efficiently supplied.

In addition, the outdoor air circulation fan which forces the introduction and the discharge of the outdoor air is provided, so that the heat of the refrigerator can be easily dissipated. Particularly, by disposing a heat dissipating duct in outer space of the storage chamber and circulating the outdoor air, heat exchange with the heat dissipating heat sink of the thermoelectric device module can be facilitated.

In addition, there is an advantage that the refrigerator can be installed stably by providing the contact mechanism on the upper portion of the refrigerator, and the refrigerator is installed in the storage space of the relative object such as furniture and then is in contact with the wall of the relative object.

Particularly, even if there is a concern that the distance between the outer surface of the refrigerator and the wall is relatively large and thus the refrigerator may be shaken, the contact mechanism may protrude from the outer surface of the refrigerator and contact the wall, and thus this concern can be dispelled.

Further, the contact mechanism is provided with a guide plate having a side surface extending obliquely in the front and rear direction, the guide plate is moved forward and backward by the lever operation of the user, and the forward and backward movement is switched to the lateral movement of the contact member, and thus there is an advantage that the contact member and the wall of the furniture can be in contact with each other.

Further, since the lever is provided with the engaging member, and the user operates the lever so that the refrigerator is in contact with the wall of the furniture or the like, and thus the engaging member is engaged to the rack, the contact portion of the refrigerator can be prevented from being moved.

In addition, since the contact mechanism can be provided inside the outer case of the refrigerator, an outer appearance of the refrigerator may be aesthetically pleasing.

In addition, since the lever provided to the contact mechanism can be provided on the front portion or the upper portion of the contact mechanism housing, the user's operating convenience can be improved.

DETAILED DESCRIPTION OF THE EMBODIMENTS

Figure 1:
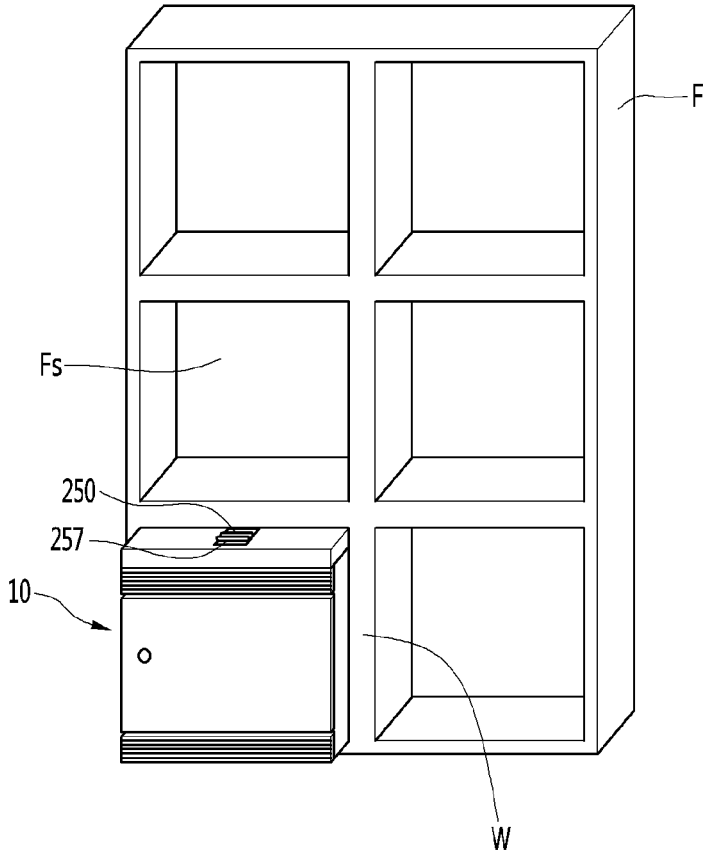
FIG. 1 is a view illustrating a state where a refrigerator according to a first embodiment of the present invention is in a built-in furniture.

Hereinafter, some embodiments of the present invention will be described in detail with reference to exemplary drawings. It should be noted that, in adding reference numerals to the constituent elements of the drawings, the same or similar constituent elements may be denoted by the same reference numerals even though they are illustrated in different drawings. In addition, in the following description of the embodiments of the present invention, a detailed description with respect to known configurations or functions incorporated herein may be omitted in a case where it is determined that the understanding thereof is obstructed.

Also, terms such as first, second, A, B, (a), (b) or the like may be used herein when describing components of the present disclosure. These terms are intended to distinguish the components from the other components and are not to limit an essence, order, sequence, or the like of a corresponding component. It should be understood that if it is described in the specification that one component is "connected," "coupled", or "joined" to another component, the one component may be directly connected, coupled, or joined to the another component, but another component may be "connected", "coupled", or "joined" between components.

Figure 2:
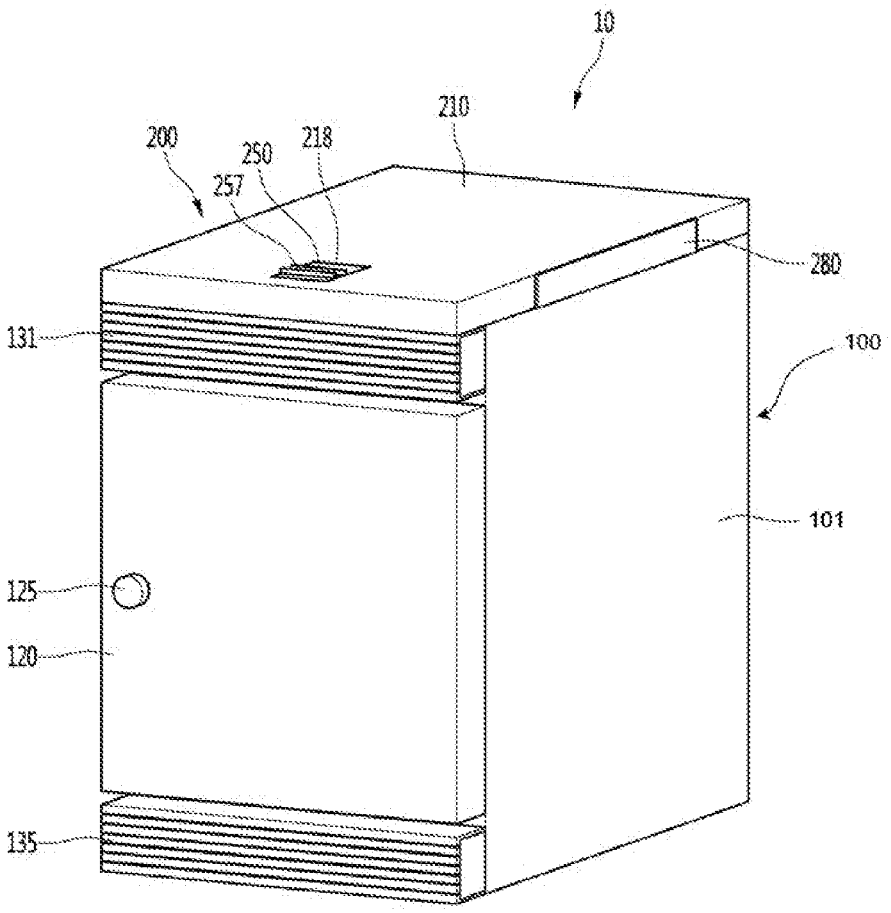
FIG. 2 is a view illustrating a configuration of the refrigerator according to the first embodiment of the present invention.
Figure 3:
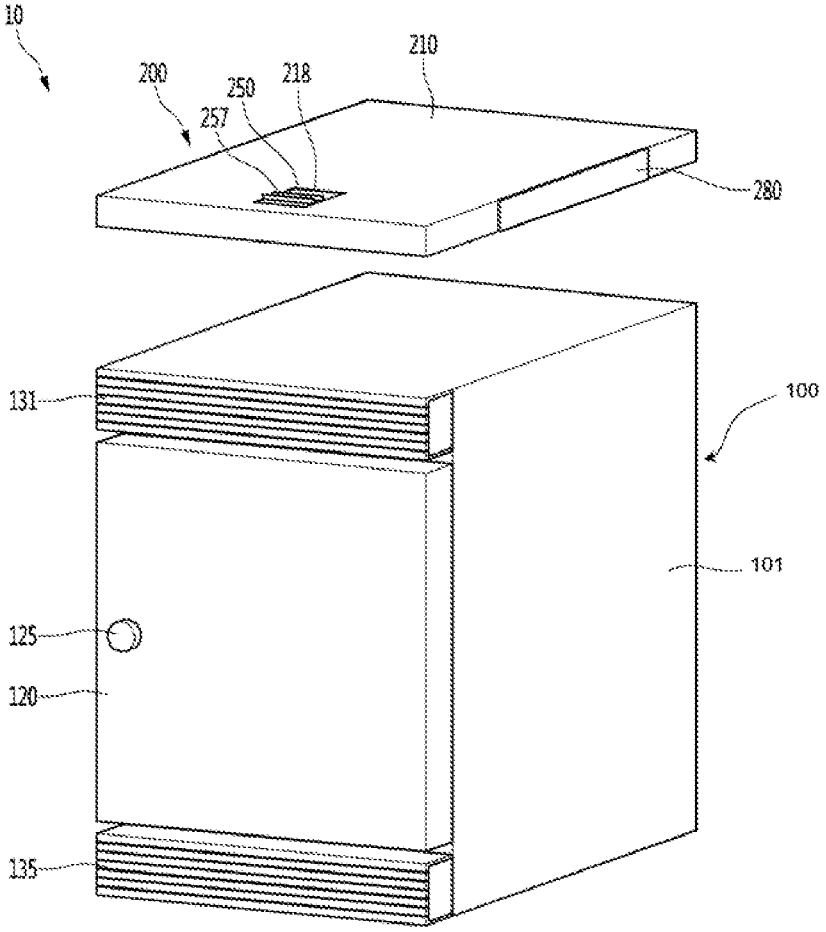
FIG. 3 is an exploded perspective view illustrating a configuration of the refrigerator according to the first embodiment of the present invention.

FIG. 1 is a view illustrating a state where a refrigerator according to a first embodiment of the present invention is in a built-in furniture, FIG. 2 is a view illustrating a configuration of the refrigerator according to the first embodiment of the present invention, and FIG. 3 is an exploded perspective view illustrating a configuration of the refrigerator according to the first embodiment of the present invention.

First, referring to FIG. 1, a refrigerator 10 according to the first embodiment of the present invention may be housed in a storage space defined by a wall of an object to be installed. For example, the refrigerator 10 may be understood as a refrigerator which is installed by being embedded in a wall or furniture of a home or office. For example, FIG. 1 illustrates a state where the refrigerator 10 is installed in a storage space Fs formed in an object to be installed, in this case, a furniture F.

The refrigerator 10 may be installed by being fixed to the furniture F or may be detachably installed. In other words, the refrigerator 10 may be a portable refrigerator, and the refrigerator 10 may be normally used in a state of being inserted into the storage space Fs of the furniture F and may be taken out and used as an ice box by separating the refrigerator 10 from the furniture F when there is an event such as a picnic. When inserted, an outer surface of the refrigerator 10 may be positioned adjacent to the wall W of the furniture F.

The refrigerator 10 may be configured to have a relatively small size and a small weight so as to facilitate the carrying by the user. For example, the refrigerator 10 may be formed in a dimension of 30 to 50 cm in width, length, and height and the weight of the refrigerator 10 may be 10 to 15 kg or less.

The refrigerator 10 includes a refrigerator main body in which a food storage space is formed, and a contact mechanism 200 provided on an upper side of the refrigerator main body. For example, the contact mechanism 200 may be installed on an outer side of the outer case 101.

The refrigerator main body includes a cabinet 100 for forming a storage chamber and a door 120 for opening and closing the storage chamber. The refrigerator main body may be provided with inlet and outlet grilles 131 and 135 which are disposed on upper and lower sides of the door 120 to allow outdoor air to flow in and out of the refrigerator.

The contact mechanism 200 includes a housing 210 which is seated on an upper side of the cabinet 100. The housing 210 has a substantially hexahedral shape, and a power transmission element for moving a contact member 280 may be included in the housing 210. The contact member 280 may be disposed on both side surfaces of the housing 210.

A cutout portion 218 is formed at an upper portion of the housing 210 on which a lever 250 and an engaging member 257 are installed. The cutout portion 218 includes a through-hole formed through an upper surface of the housing 210. The lever 250 and the engaging member 257 protrude upward from the cutout portion 218.

When the user moves the lever 250 forward or backward, the contact member 280 may be drawn out from the side surface of the housing 210 in the lateral direction or be drawn in the opposite direction thereof according to the movement of the lever 250.

Figure 4:
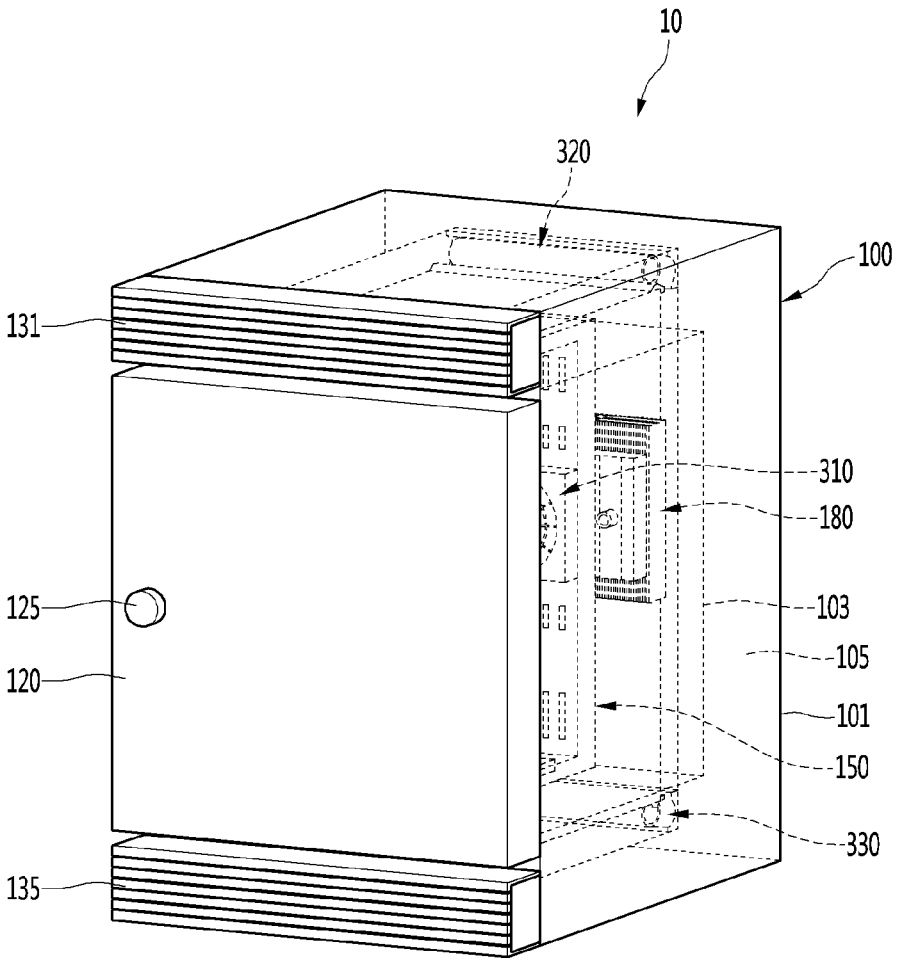
FIG. 4 is a perspective internal view illustrating a main body configuration of the refrigerator according to the first embodiment of the present invention.
Figure 5:
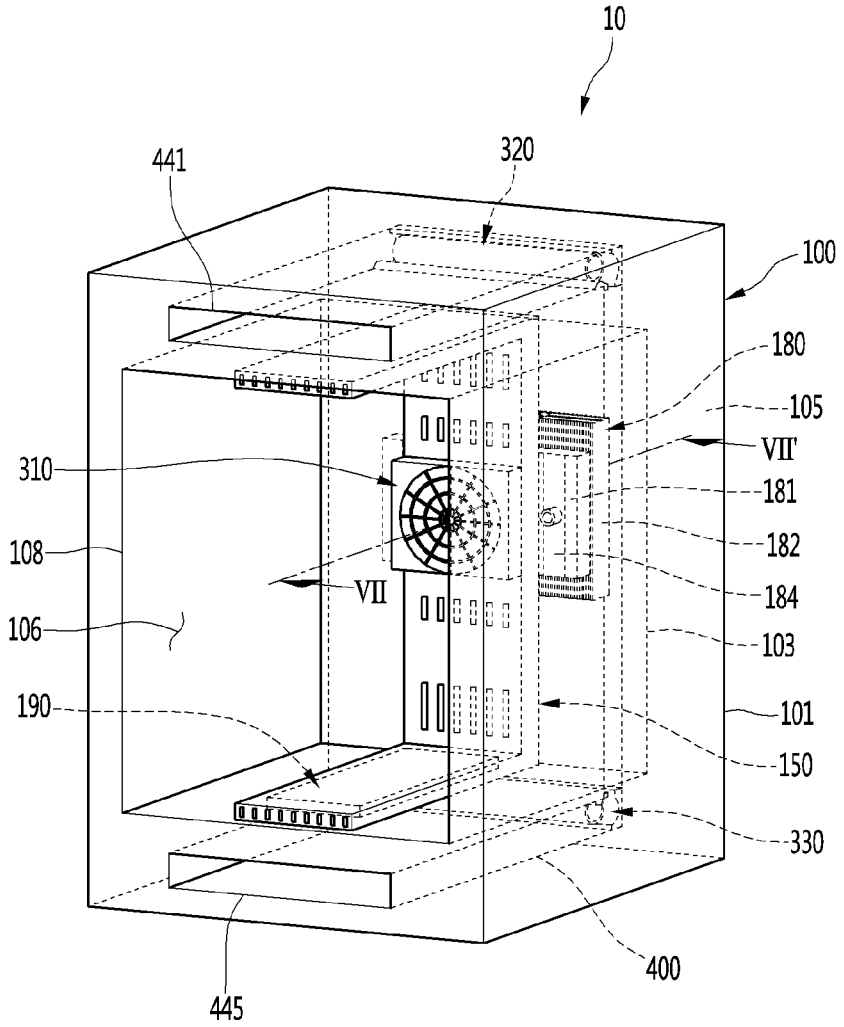
FIG. 5 is a view illustrating an internal configuration of the main body of the refrigerator according to the first embodiment of the present invention.
Figure 6:
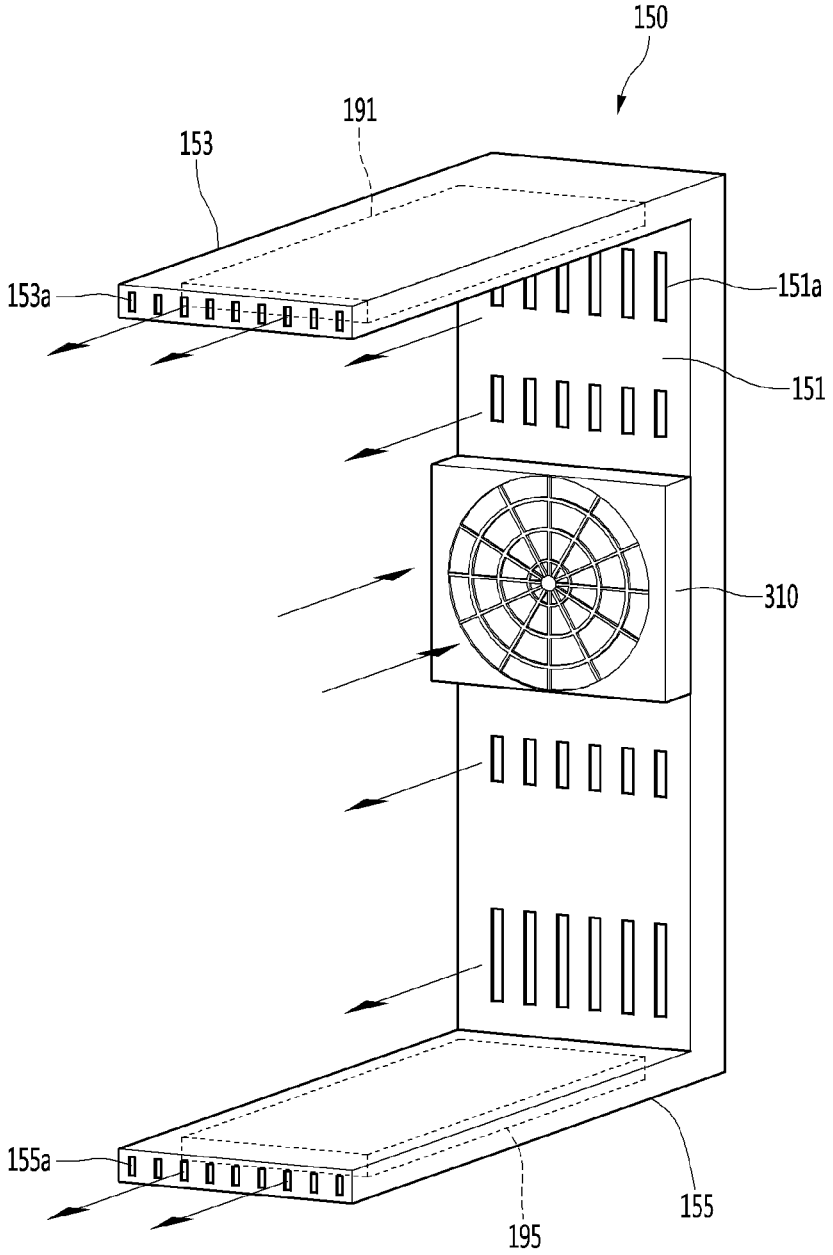
FIG. 6 is a perspective view illustrating a configuration of a supply duct according to the first embodiment of the present invention.
Figure 7:
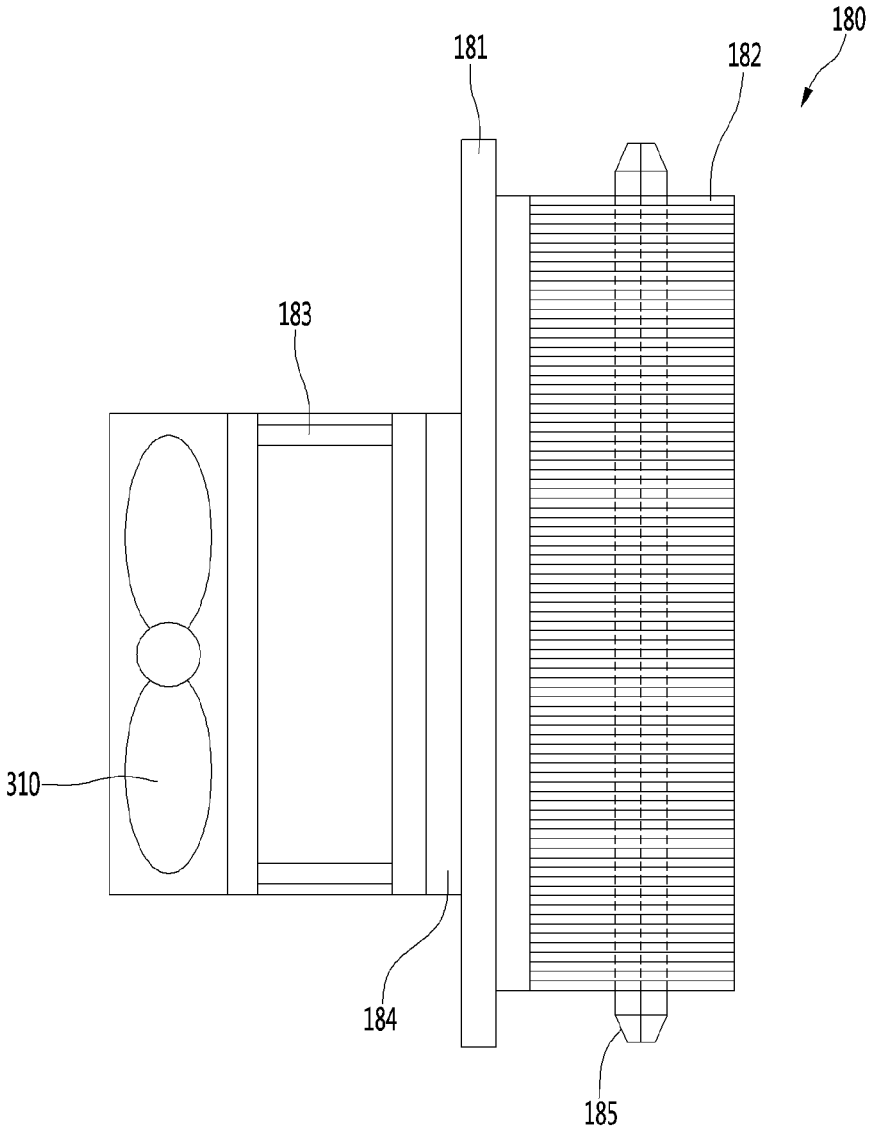
FIG. 7 is a view illustrating a configuration of a thermoelectric device module according to an embodiment of the present invention.

FIG. 4 is a perspective internal view illustrating a main body configuration of the refrigerator according to the first embodiment of the present invention, FIG. 5 is a view illustrating an internal configuration of the main body of the refrigerator according to the first embodiment of the present invention, FIG. 6 is a perspective view illustrating a configuration of a supply duct according to the first embodiment of the present invention, and FIG. 7 is a view illustrating a configuration of a thermoelectric device module according to an embodiment of the present invention.

Referring to FIGS. 4 to 7, the refrigerator 10 according to the first embodiment of the present invention includes a cabinet 100 forming an outer appearance and a storage chamber 106 for storing food, and a door 120 for opening and closing the storage chamber 106. For example, the cabinet 100 is configured to have a rectangular parallelepiped shape having an opened front portion, and the door 120 may have a rectangular panel shape.

The door 120 may be provided to be rotatable. For example, one side portion of the door 120 may be hinged to the cabinet 100 and an other side portion thereof may be rotated forward and backward about the one side portion of the door 120. For example, the one side portion may be a right side portion, and the other side portion may be a left side portion. A handle 125 operated by a user may be provided on a front surface of the door 120.

The cabinet 100 includes an outer case 101 and an inner case 103 disposed inside the outer case 101 and forming a wall of the storage chamber 106. The outer case 101 may be positioned adjacent to the wall W of the furniture F and may be configured to surround an outer side of the inner case 103.

The cabinet 100 includes a cabinet insulation material 105 disposed between the outer case 101 and the inner case 103 to insulate the storage chamber 106 and the outside of the refrigerator 10. For example, the cabinet insulation material 105 may be formed of polyurethane foam.

The refrigerator 10 further includes a thermoelectric device module 180 disposed inside the cabinet 100 for generating cool air. For example, the thermoelectric device module 180 may be installed on a rear wall of the storage chamber 106. Since the refrigerator 10 is not provided with a component for driving a freezing cycle, that is, as an example, a high noise generation source such as a compressor, there is an effect that the noise generated during the driving of the refrigerator 10 may be reduced.

The thermoelectric device module 180 may be installed on the rear wall of the storage chamber 106 to cool the storage chamber 106. The thermoelectric device module 180 includes a thermoelectric device, and the thermoelectric device refers to a device that implements cooling and heat generation using a Peltier effect. When the heat absorbing side of the thermoelectric device is disposed so as to face the storage chamber 106 and the heat generating side of the thermoelectric device is disposed so as to face the outside of the refrigerator 10, the storage chamber 106 may be cooled through the operation of the thermoelectric device.

The thermoelectric device module 180 includes a module main body 181 which is coupled with the thermoelectric device and has a rectangular plate shape, an endothermic heat sink 183 which is provided at one side of the module main body 181 and performs heat exchange with cool air of the storage chamber 106, and an exothermic heat sink 182 which is provided at an other side of the module body 181 and performs heat exchange with the outdoor air.

One side of the module main body 181 may mean a direction facing the storage chamber 106 with respect to the thermoelectric device module 180 and the other side thereof may mean a direction facing the outside of the refrigerator 10.

The endothermic heat sink 183 may be disposed so as to be in contact with the heat absorbing portion of the thermoelectric device, and the exothermal heat sink 182 may be disposed so as to be in contact with the heat dissipating portion of the thermoelectric device. The heat absorbing portion and the heat dissipating portion of the thermoelectric device have a shape capable of surface contact and may form surfaces opposite to each other.

In the thermoelectric device module 180, heat dissipation should be performed rapidly in the heat dissipating portion of the thermoelectric device, so that sufficient heat absorption may be achieved in the heat absorbing portion of the thermoelectric device. Therefore, the heat exchange area of the exothermal heat sink 182 may be larger than the heat exchange area of the endothermic heat sink 183.

The endothermic heat sink 182 and the exothermal heat sink 183 may respectively include a base contacting the thermoelectric device and a heat transfer fin coupled to the base.

In addition, a heat pipe 185 may be further included in the endothermic heat sink 182 for rapid heat dissipation of the endothermic heat sink 182. The heat pipe 185 is configured to receive a heat transfer fluid therein, one end of the heat pipe 185 may pass through the base, and the other end thereof may pass through the heat transfer fin.

The thermoelectric device module 180 may further include a module insulation material 184 installed between the endothermic heat sink 183 and the endothermic heat sink 182. For example, the module insulation material 184 may be disposed to surround an edge rim of the thermoelectric device.

A cool air circulation fan 310 which forces cool air circulation in the storage chamber 106 may be installed on a front side of the thermoelectric device module 180, that is, on the side of the thermoelectric device module 180 facing the storage chamber 106. The cool air circulation fan 310 may be positioned in front of the endothermic heat sink 183. For example, the cool air circulation fan 310 may include a centrifugal fan which sucks cool air in an axial direction and discharges the cool air in a radial direction.

The refrigerator 10 may further include a supply duct 150 for guiding cool air flow generated by the cool air circulation fan 310. The supply duct 150 may be coupled to the inner case 103 to supply cool air toward the storage chamber 106. In detail, cool air existing in the storage chamber 106 flows into the supply duct 150, and the supply duct 150 may perform a function in which cool air heat-exchanged with the endothermic heat sink 183 is discharged out to the storage chamber 106 again.

The supply duct 150 may be disposed on the rear wall, an upper wall, and a lower wall of the storage chamber 106 to discharge the cool air into the storage chamber 106. In one example, the supply duct 150 may be disposed by being bent at least twice and to have a "⊏" shape. The bent angle of the supply duct 150 may be 90 degrees.

The endothermic heat sink 183 of the thermoelectric module 180 may be disposed inside the supply duct 150. Therefore, the cool air introduced into the supply duct 150 may be cooled while exchanging heat with the endothermic heat sink 183. The cooled cool air may be discharged from the supply duct 150 and may be introduced into the storage chamber 106.

A cold storage agent 190 may be installed in the supply duct 150. The cold storage agent 190 stores the coolness of the cool air by being cooled by the cool air flowing through the supply duct 150, and when the cool air circulation fan 310 is stopped, for example, when the refrigerator 10 is moved, the stored coolness of the cool air is discharged, and the cold storage agent 190 performs a function of keeping the storage chamber 106 in the cool state. The cold storage agent 190 may include a phase change material (PCM) which discharges cool air during a phase change process. For example, the cold storage agent 190 may include water or ice, clathrate, or eutectic salt.

The refrigerator 10 may further include a heat dissipating duct 400 for guiding the flow of the outdoor air. The outdoor air outside the refrigerator 10 flows into the heat dissipating duct 400 and is heat exchanged with the exothermic heat sink 182. The outdoor air is then discharged to the outside of the refrigerator 10 again. The exothermic heat sink 182 may be disposed inside the heat dissipating duct 400.

The heat dissipating duct 400 may be disposed to be embedded in the cabinet insulation material 105 and may be disposed at the rear portion, an upper portion, and a lower portion of the cabinet 100. For example, the heat dissipating duct 400 may be bent at least twice so as to have a "⊏" shape. The bent angle of the heat discharging duct 400 may be 90 degrees. The heat dissipating duct 400 may be disposed along an outer perimeter of the supply duct 150.

The heat dissipating duct 400 may include a first inlet and outlet portion 441 and a second inlet and outlet portion 445 for introducing or discharging outdoor air. The first inlet and outlet portion 441 may be disposed at an upper end portion of the heat dissipating duct 400 and the second inlet and outlet portion 445 may be disposed at a lower end portion of the heat dissipating duct 400.

The refrigerator 100 may further include heat dissipating fans 320 and 330 disposed in an internal flow path of the heat dissipating duct 400 for forcing the flow of the outdoor air. The heat dissipating fans 320 and 330 include a first heat dissipating fan 320 disposed at an upper portion of the heat dissipating duct 400 and a second heat dissipating fan 330 disposed at a lower portion of the heat dissipating duct 400. The first heat dissipating fan 320 may be disposed at an upper bent portion of the heat dissipating duct 400 and the second heat dissipating fan 330 may be disposed at a lower bent portion of the heat dissipating duct 400.

According to the rotation direction of the first and second heat dissipating fans 320 and 330, the flow direction of the outdoor air in the first and second inlet and outlet portions 441 and 445 may be different. In this regard, this will be described later with reference to FIGS. 8 and 9.

In the front of the cabinet 100, inlet and outlet grilles 131 and 135 for flowing outdoor air into the heat dissipating duct 400 and discharging the outdoor air heat-exchanged in the heat dissipating duct 400 to the outside of the refrigerator are included. The inlet and outlet grilles 131 and 135 include a first inlet and outlet grill 131 disposed at an upper portion of the cabinet 100 and a second inlet and outlet grill 135 disposed at a lower portion of the cabinet 100.

The first inlet and outlet grill 131 is positioned on the upper side of the door 120 and is positioned in front of the first inlet and outlet portion 441 and communicates with the first inlet and outlet portion 441. The second inlet and outlet grill 135 is positioned below the door 120 and is positioned in front of the second inlet and outlet portion 445 and communicates with the second inlet and outlet portion 445.

The supply duct 150 will be described in more detail.

The supply duct 150 may be installed in the rear wall, the top wall, and the bottom wall of the storage chamber 106.

In detail, the supply duct 150 includes a first supply duct 151 installed in the inner case 103 forming a rear wall of the storage chamber 106. The first supply duct 151 may extend vertically from the rear wall of the storage chamber 16. The cool air circulation fan 310 may be installed at a central portion of the first supply duct 151.

The endothermic heat sink 183 of the thermoelectric device module 180 may be positioned in the first supply duct 151. Therefore, the cool air flowing through the first supply duct 151 may exchange heat with the endothermic heat sink 183.

The cool air existing in the storage chamber 106 may be sucked into the cool air circulation fan 310 by driving the cool air circulation fan 310 and may be cooled while passing the endothermic heat sink 183 positioned at the rear of the cool air circulation fan 310. The cooled cool air may flow upward and downward the first supply duct 151 towards the upper and lower portions of the first supply duct 151.

In the supply duct 150, a plurality of cool air discharge holes 151*a*, 153*a*, and 155*a* may be formed. The first supply duct 151 is provided with a first discharge hole 151*a* for discharging cool air into the storage chamber 106. The first discharge hole 151*a* may be formed on the front surface of the first supply duct 151 and may be exposed to the storage chamber 106. The cool air discharged from the first discharge hole 151*a* may flow towards a front portion of the storage chamber 106.

The supply duct 150 includes a second supply duct 153 installed in the inner case 103 forming the upper wall of the storage chamber 106. The second supply duct 153 may extend forward from the upper portion of the first supply duct 151. The cool air which has flowed from the cool air circulation fan 310 to the upper portion of the first supply duct 151 may flow forward through the second supply duct 153.

A second discharge hole 153*a* for discharging the cool air of the second supply duct 153 to the front portion of the storage chamber 106 may be formed in a front portion of the second supply duct 153. For example, the second discharge hole 153*a* may be formed at the front end portion of the second supply duct 153 and may be positioned adjacent to the door 120. Accordingly, the cool air discharged from the second discharge hole 153*a* may be discharged to a side of the door 120 and may be supplied to the front portion of the storage chamber 106 along an inner surface of the door 120.

The supply duct 150 further includes a third supply duct 155 installed in the inner case 103 forming the lower wall of the storage chamber 106. The third supply duct 155 may extend forward from the lower portion of the first supply duct 151. The cool air which has flowed from the cool air circulation fan 310 to the lower portion of the first supply duct 151 may flow forward through the third supply duct 155.

A third discharge hole 155*a* for discharging the cool air of the third supply duct 155 to the front portion of the storage chamber 106 is formed in a front portion of the third supply duct 155. For example, the third discharge hole 155*a* may be formed at a front end portion of the third supply duct 155 and may be positioned adjacent to the door 120. Therefore, the cool air discharged from the third discharge hole 155*a* may be discharged to the side of the door 120 and may be supplied to the front portion of the storage chamber 106 along the inner surface of the door 120.

The refrigerator 10 further includes a cold storage agent 190 installed inside the supply duct 150. The cold storage agent 190 may have a thin flat plate shape and have a predetermined length.

The cold storage agent 190 may be cooled by cool air flowing through the supply duct 150 to store the coolness of the cool air. The coolness of the cool air stored in the cold storage agent 190 may cool the storage chamber 106 by way of conduction or convection. As described above, the cold storage agent 190 may include a phase change material.

The cold storage agent 190 may be installed in the second supply duct 153 or the third supply duct 155. The second supply duct 153 or the third supply duct 155 may be configured to extend forward from the first supply duct 151 so that the cold storage agent 190 may be easily installed in the second and third ducts 153 and 155.

The cold storage agent 190 may include a first cold storage agent 191 installed in the second supply duct 153. The cool air flowing through the second supply duct 153 may cool the first cold storage agent 191 and the cooled first cold storage agent 191 may discharge the coolness of the cool air during the phase change process. For example, when the refrigerator 10 is carried and the cool air circulation fan 310 is not driven, the coolness of the cool air stored in the first cold storage agent 191 may be supplied to the storage chamber 106.

The cold storage agent 190 may include a second cold storage agent 195 installed inside the third supply duct 155. The cool air flowing through the second supply duct 153 may cool the second cold storage agent 195 and the cooled second cold storage agent 195 may cool the cool air during the phase change process. For example, when the refrigerator 10 is carried and the cool air circulation fan 310 is not driven, the coolness of the cool air stored in the second cold storage agent 195 may be supplied to the storage chamber 106.

Figure 8:
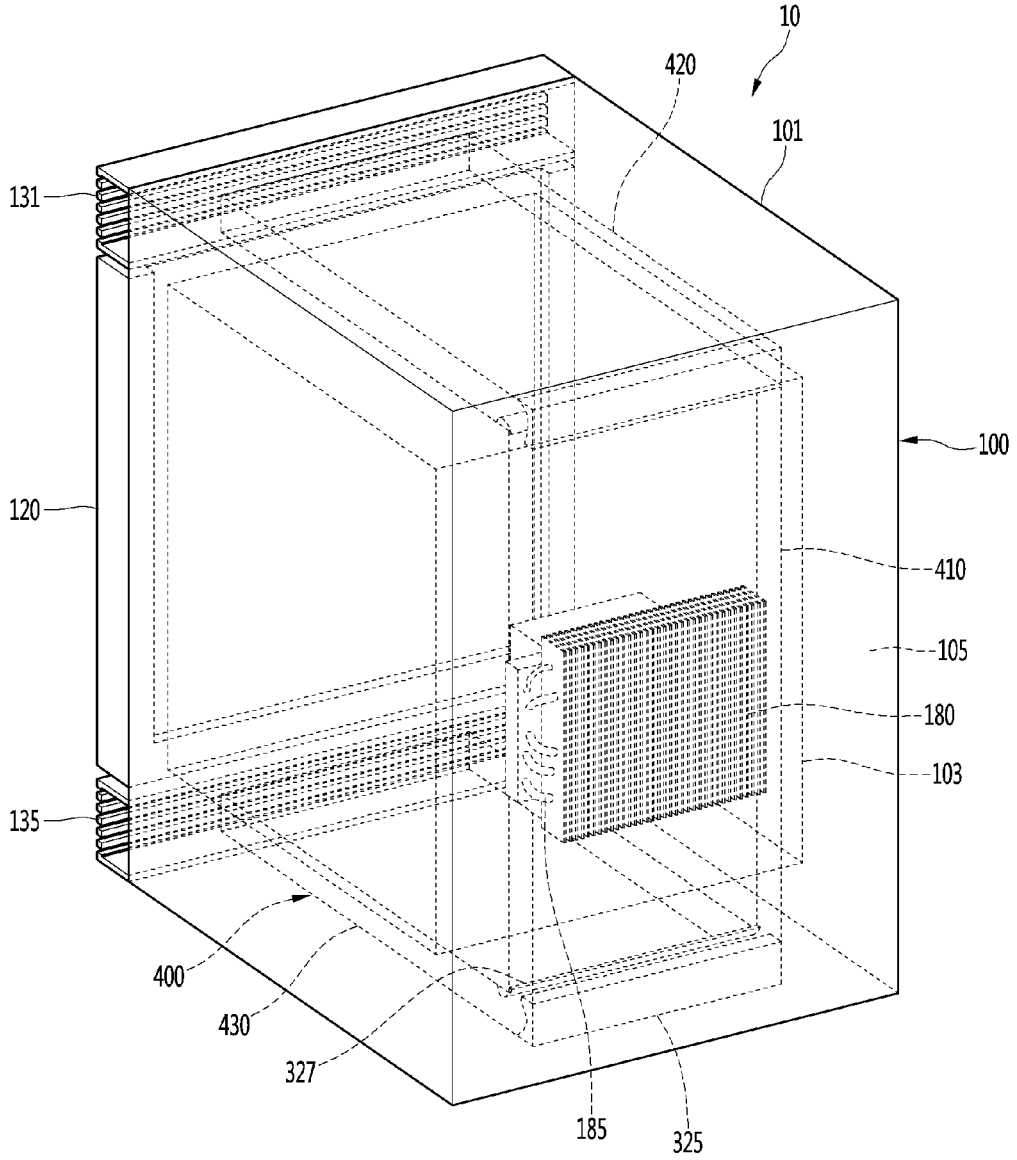
FIG. 8 is an internal view illustrating a state where a heat dissipating duct according to the first embodiment of the present invention is disposed inside a cabinet.
Figure 9:
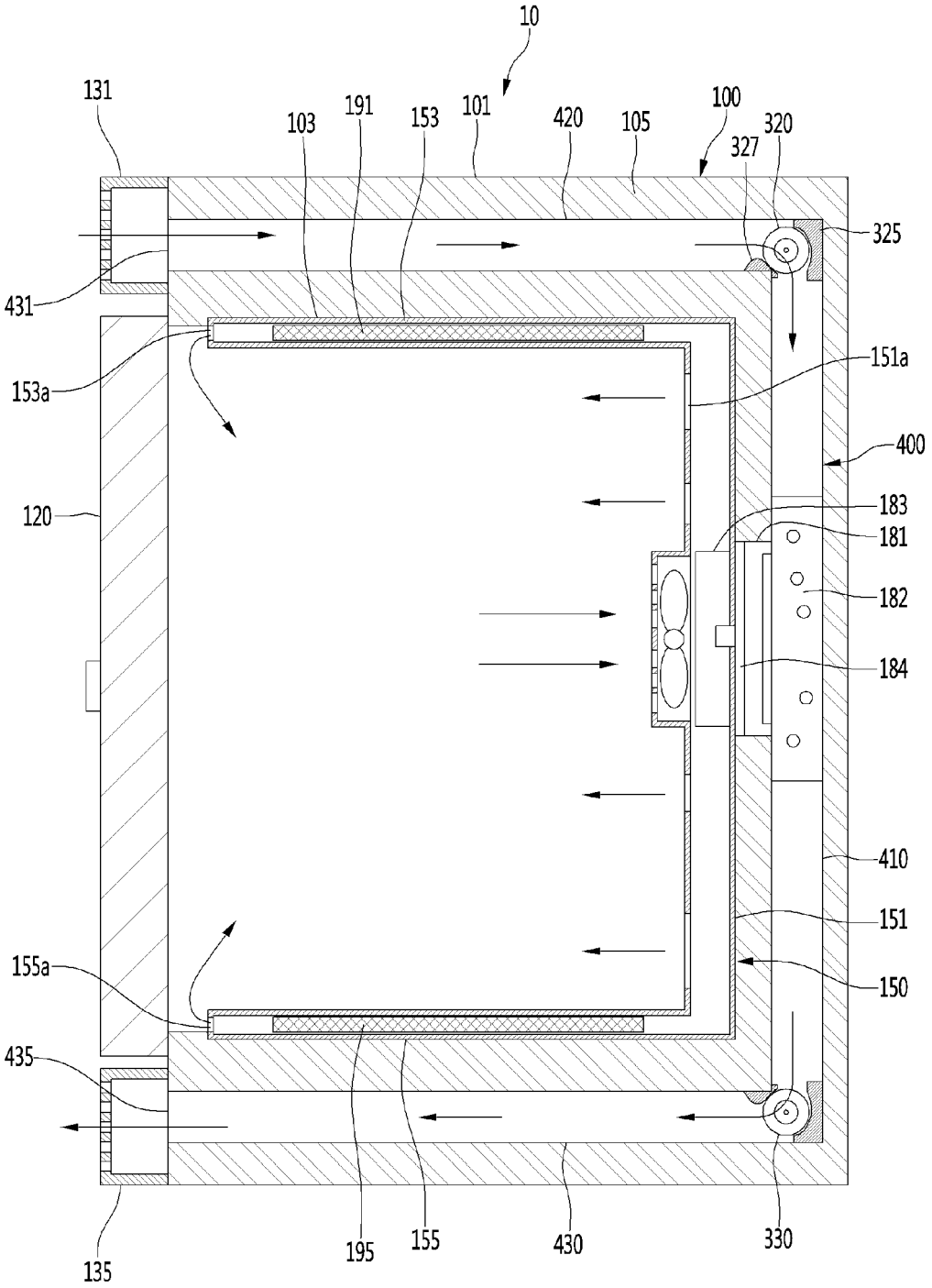
FIG. 9 is a view illustrating a state relating to a flow of cool air and outdoor air in a structure of the refrigerator according to the first embodiment of the present invention.

FIG. 8 is a view illustrating a state where the heat dissipating duct according to the first embodiment of the present invention is disposed inside the cabinet, and FIG. 9 is a view illustrating a state of relating to a flow of cool air and outdoor air in a structure of the refrigerator according to the first embodiment of the present invention.

Referring to FIGS. 8 and 9, the refrigerator 10 according to the first embodiment of the present invention further includes the heat dissipating duct 400 which is embedded in the cabinet insulation material 105. The heat dissipating duct 400 may be understood as a duct communicating with the outdoor air.

The heat dissipating duct 400 includes a first heat dissipating duct 410 installed on the cabinet insulation material 105 provided at the rear portion of the cabinet 100, a second heat dissipating duct 420 extending forward from an upper portion of the first heat dissipating duct 410, the second heat dissipating duct 420 communicating with the first inlet and outlet grill 131, and a third heat dissipating duct 430 extending forward from a lower portion of the first heat dissipating duct 410 and communicating with the second inlet and outlet grill 135.

The exothermic heat sink 182 of the thermoelectric device module 200 may be positioned in the first heat dissipating duct 410. Therefore, the outdoor air flowing through the first heat dissipating duct 410 may exchange heat with the exothermic heat sink 182.

A first inlet and outlet portion 431 which is disposed adjacent to the first inlet and outlet grill 131 and introduces outdoor air introduced through the first inlet and outlet grill 131 or guides the air of the second heat dissipating duct 420 to the first inlet and outlet grill 131 is provided in the front end portion of the second heat dissipating duct 420.

A second inlet and outlet portion 435 which is disposed adjacent to the second inlet and outlet grill 135 and introduces outdoor air introduced through the second inlet and outlet grill 135 or guides the air of the third heat dissipating duct 430 to the second inlet and outlet grill 135 is provided in the front end portion of the third heat dissipating duct 430.

The first and second heat dissipating fans 320 and 330 may be installed in the heat dissipating duct 400 to force circulation of the outdoor air. The first heat dissipating fan 320 may be installed on the upper portion of the first heat dissipating duct 410, that is, a portion where the first heat dissipating duct 410 and the second heat dissipating duct 420 meet. The second heat dissipating fan 330 may be installed at the lower portion of the first heat dissipating duct 410, that is, a portion where the first heat dissipating duct 410 and the third heat dissipating duct 430 meet.

The first and second heat dissipating fans 320 and 330 may include a cross-flow fan. The cross-flow fan is a fan which sucks air in a circumferential direction and discharges air in the circumferential direction and the air flowing from the first heat dissipating duct 410 to the second heat dissipating duct 420 or the third heat dissipating duct 430 may be guided.

Flow guide portions 325 and 327 that guide for a stable flow of air may be installed around the first and second heat dissipating fans 320 and 330, respectively. The flow guide portions 325 and 327 include a rear guide 325 provided at one side of the heat dissipating fans 320 and 330 and a stabilizer 327 provided at an other side thereof.

The rear guide 325 is disposed adjacent to an outer circumferential surface of the heat dissipating fans 320 and 330 to guide the air sucked by the heat dissipating fans 320 and 330 to be discharged in the circumferential direction. The stabilizer 327 may prevent the air discharged from the heat dissipating fans 320 and 330 from being sucked back to the suction side of the heat dissipating fans 320 and 330.

The flow of cool air and outdoor air in the refrigerator 10 will be described.

According to the rotational direction of the first heat dissipating fan 320 and the second heat dissipating fan 330, the directions of inflow and outflow of the outdoor air may be different from each other.

For example, referring to FIG. 9, when the first and second heat dissipating fans 320 and 330 rotate clockwise, the outdoor air flows into the second heat dissipating duct 420 through the first inlet and outlet grill 131. The outdoor air is heat-exchanged with the exothermic heat sink 182 disposed in the first heat dissipating duct 410, absorbs heat, and then is discharged from the third heat dissipating duct 430 through the second inlet and outlet grill 135.

However, unlike this, when the first and second heat dissipating fans 320 and 330 rotate in a counterclockwise direction, the outdoor air flows into the third heat dissipating duct 430 through the second inlet and outlet grill 135. The outdoor air is heat-exchanged with the exothermic heat sink 182 disposed in the first heat dissipating duct 410, absorbs heat, and then is discharged from the second heat dissipating duct 420 through the first inlet and outlet grill 131.

Meanwhile, when the cool air circulation fan 310 is driven, the cool air existing in the storage chamber 106 flows into the cool air circulation fan 310 and may cool while passing the endothermic heat sink 183 positioned at the rear of the cool air circulation fan 310. Some of the cool air in the cooled cool air may be discharged to the storage chamber 106 through the first discharge hole 151*a* of the first supply duct 151.

Some of the cool air flow to the upper portion of the first supply duct 151, flow forward through the second supply duct 153, and is discharged to the storage chamber 106 through the second discharge hole 153*a*. The remaining cool air may flow to the lower portion of the first supply duct 151, flow forward through the third supply duct 155, and be discharged to the storage chamber 106 through the third discharge hole 155*a*.

Figure 10:
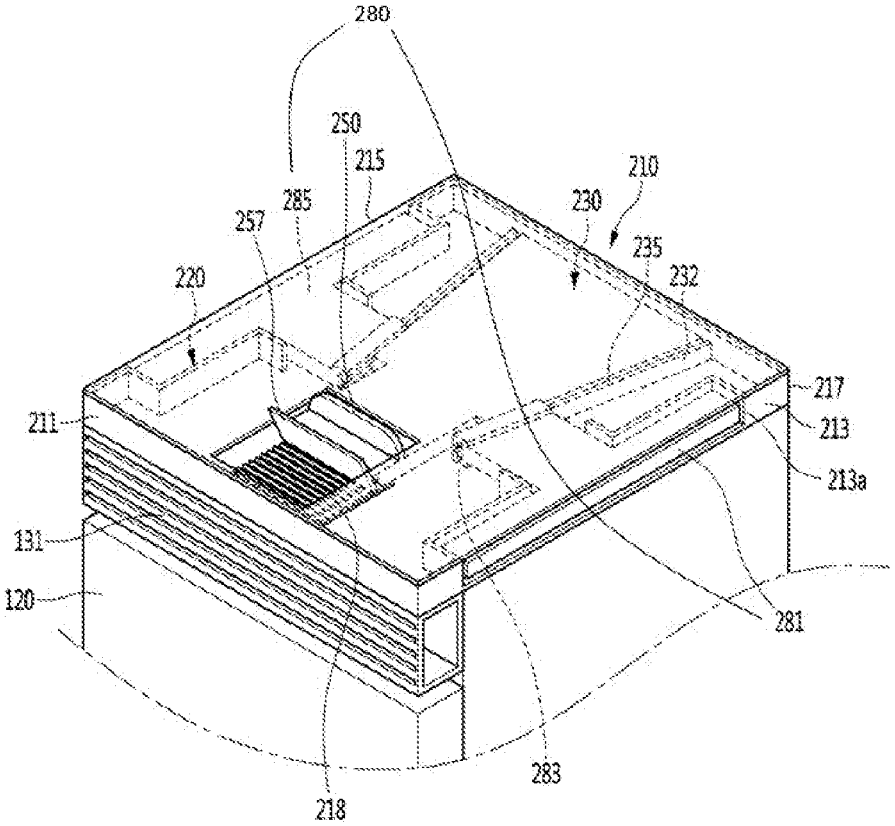
FIG. 10 is a view illustrating an upper configuration of the refrigerator according to the first embodiment of the present invention.
Figure 11:
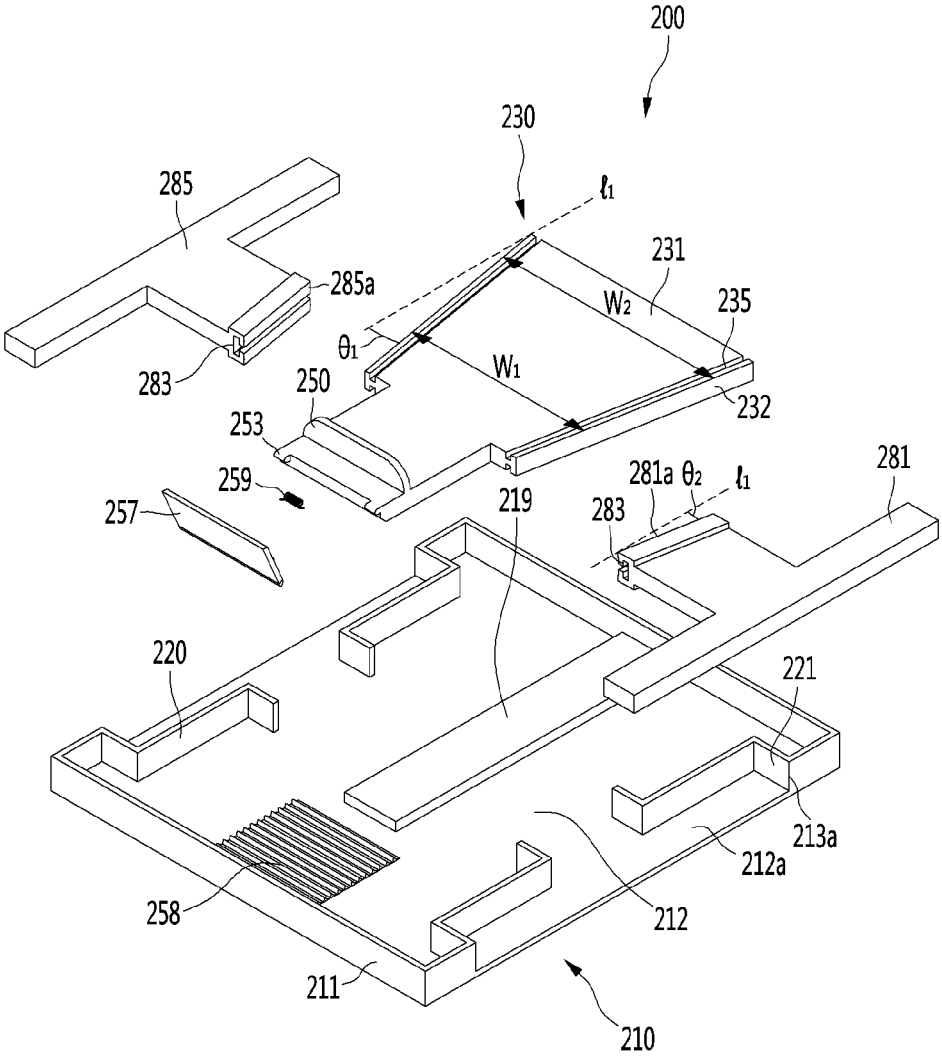
FIG. 11 is an exploded perspective view illustrating a configuration of a contact mechanism according to the first embodiment of the present invention.
Figure 12:
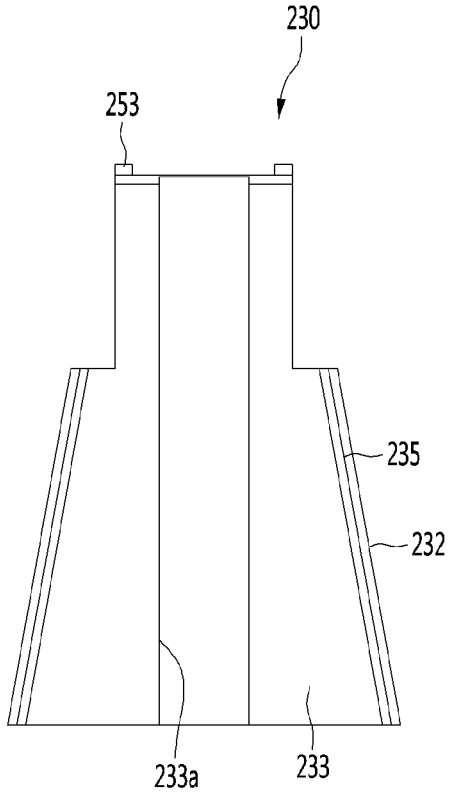
FIG. 12 is a view illustrating a bottom configuration of a guide plate according to the first embodiment of the present invention.
Figure 13:
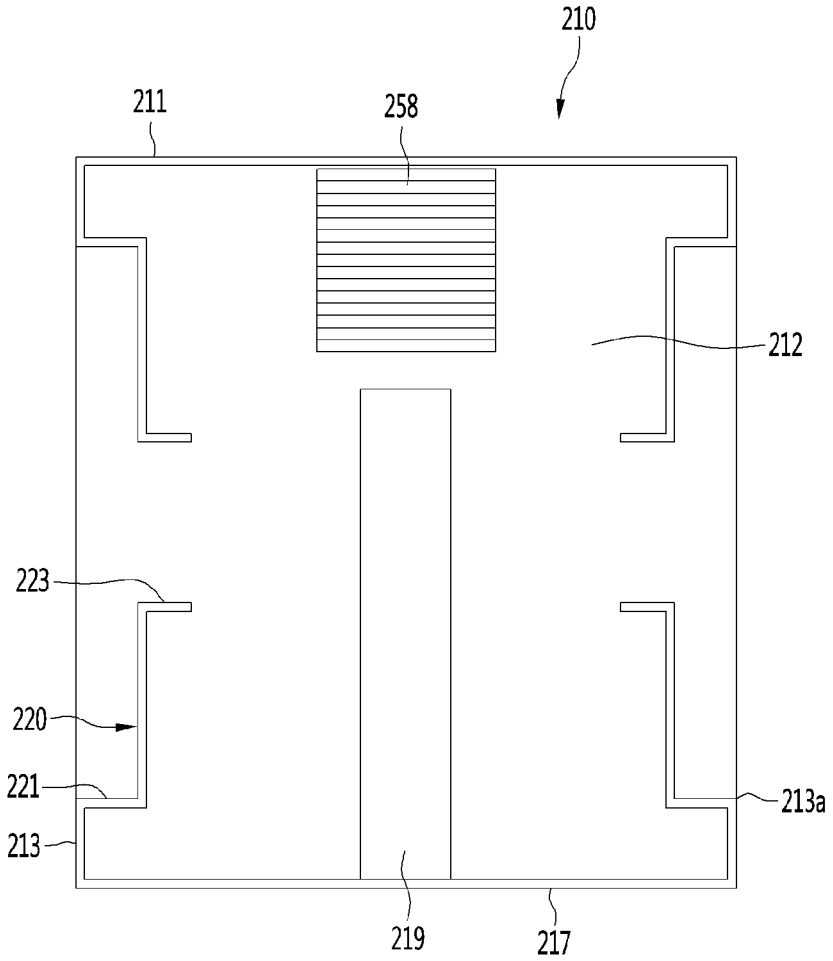
FIG. 13 is a view illustrating a configuration of a housing according to the first embodiment of the present invention.
Figure 14:
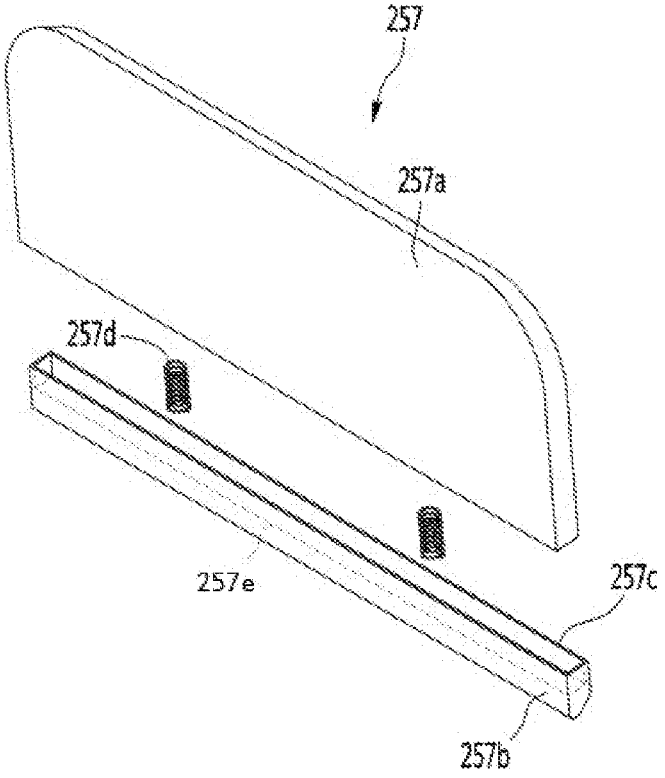
FIG. 14 is a view illustrating a configuration of an engaging member according to the first embodiment of the present invention.

FIG. 10 is a view illustrating an upper configuration of the refrigerator according to the first embodiment of the present invention, FIG. 11 is an exploded perspective view illustrating a configuration of a contact mechanism according to the first embodiment of the present invention, FIG. 12 is a view illustrating a bottom configuration of a guide plate according to the first embodiment of the present invention, FIG. 13 is a view illustrating a configuration of a housing according to the first embodiment of the present invention, and FIG. 14 is a view illustrating a configuration of an engaging member according to the first embodiment of the present invention.

Referring to FIGS. 10 to 14, the refrigerator 10 according to the first embodiment of the present invention includes a contact mechanism 200 disposed on one side of the refrigerator main body. The contact mechanism 200 may be understood as a mechanism for bringing the refrigerator 10 into contact with an object to be installed in by a user's operation. At least a portion of the refrigerator 10 may be brought into contact with one surface of the object to be installed in. For example, the object to be installed in includes the furniture F illustrated in FIG. 1, and a wall W of the furniture F may be a surface where at least a portion of the refrigerator 10 is in contact. The contact mechanism 200 includes a contact member 280 which makes contact with the wall W of the furniture F. The contact member 280 is provided on a side surface of the contact mechanism 200 and may be movably provided according to an operation of a lever 250. In detail, the contact member 280 may include a first contact member 281 provided on one side surface of the contact mechanism 200 and a second contact member 285 provided on an other side surface thereof.

In detail, the contact mechanism 200 includes a housing 210. The housing 210 may be provided with a space in which a power transmitting element for transmitting a force generated in the lever 250 to the contact member 280 is installed. For example, the housing 210 may have an outer appearance shape of a hexahedron.

The housing 210 includes a housing lower portion 212 placed on the upper surface of the cabinet 100. The housing lower portion 212 includes a support 212*a* for supporting a lower portion of the first and second contact members 281 and 285. The support portion 212*a* may be provided at two positions located at respective sides of the housing lower portion 212.

The housing 200 further includes a housing front portion 211 and a housing side portion 213. The housing side portion 213 extends rearward from both sides of the housing front portion 211. The housing 210 further includes a housing upper portion 215 which forms an upper surface of the housing 210 and connects the two housing side portions 213 and a housing rear portion 217 connecting the rear portions of the two housing side portions 213.

The housing upper portion 215 is provided with the lever 250. The lever 250 may protrude upward from the housing upper portion 215 and may be held by the user to move the lever 250 forward or backward.

A cutout portion 218 is formed in the housing upper portion 215 and the lever 250 may extend from the inside of the housing 210 to the outside of the housing 210 through the cutout portion 218. In detail, the lever 250 is provided on an upper surface of the guide plate 230 and extends upward to protrude upward from the housing upper portion 215 through the cutout portion 218. For example, the lever 250 may be positioned at a front portion of the housing upper portion 215.

The lever 250 may be provided to be linearly movable. For example, the lever 250 may be moved forward or rearward of the housing 210 or the refrigerator 10. The lever 250 may move inside the cutout portion 218.

A guide plate 230 may be provided in the housing 210 to move forward or backward together with the lever 250 and to press or pull against the contact member 280. For example, the lever 250 and the guide plate 230 may be configured to be coupled to each other or may be integrally formed with each other as a single unit. The contact member 280 may be disposed to be capable of being in contact with the guide plate 230.

The guide plate 230 may extend rearward from the lever 250. A second width W2 may be formed to be different from a first width w1 when the first width W1 of the front portion of the guide plate 230 in the lateral direction and the second width W2 of the rear portion of the guide plate 230 in the lateral direction are defined. For example, the guide plate 230 may be configured to increase the width thereof in the lateral direction toward the rear. For example, the second width W2 may be greater than the first width W1. That is, the guide plate 230 may have a wedge shape at a portion thereof.

The guide plate 230 includes a plate upper portion 231 forming an upper surface and two plate side portions 232 provided on both sides of the plate upper portion 231. The height of the plate side portion 232 may form the thickness of the guide plate 230 in the vertical direction.

As described above, since the width of the guide plate 230 in the lateral direction becomes increasingly wide going towards the rear, the plate side portion 232 has an inclined surface extending obliquely in the front and rear direction.

That is, the plate side portion 232 may obliquely extend by a first predetermined angle θ1 with respect to an extension line l1 extending backward. With such a configuration, the two plate side portions 232 may be disposed so as to gradually separate away from each other going towards the rear.

The first and second contact members 281 and 285 may be disposed on both sides of the guide plate 230. The first and second contact members 281 and 285 may be disposed to be pressed or pulled laterally when the guide plate 230 moves forward or backward. In addition, the first and second contact members 281 and 285 may be slidably coupled to the guide plate 230.

In detail, the first and second contact members 281 and 285 include member side portions 281*a* and 285*a* which are slidably fitted to the plate side portions 232 of the guide plate 230. The first contact member 281 is provided with a first member side portion 281*a* and the second contact member 285 is provided with a second member side portion 285*a*. The first and second member side portions 281*a* and 285*a* may be disposed to face the plate side portion 232.

In addition, the first and second member side portions 281*a* and 285*a* include inclined surfaces extending obliquely in the front and rear direction. In detail, the first and second member side portions 281*a* and 285*a* may obliquely extend by a second predetermined angle θ2 with respect to an extension line l1 extending backward. With such a configuration, the first and second member side portions 281*a* and 285*a* may be disposed so as to gradually separate away from each other going towards the rear.

The first predetermined angle θ1 and the second predetermined angle θ2 may have the same value. Therefore, the respective plate side portion 232 of the guide plate 230 and the first and second member side portions 281*a* and 285*a* may be disposed to be in contact with each other along a full length of the first and second member side portions 281*a* and 285*a*.

The first and second member side portions 281*a* and 285*a* may be formed with insertion grooves 283 into which the plate side portions 232 of the guide plate 230 are inserted. The insertion groove 283 may be configured so as to be recessed into the first and second side portions 281*a* and 285*a*.

At least one of the upper surface and the lower surface of the guide plate 230 may be provided with a member coupling portion 235 which is configured to be recessed. The first and second member side portions 281*a* and 285*a* may be configured to be inserted into the member coupling portion 235.

The guide plate 230 and the first and second contact members 281 and 285 may move relatively due to the configuration of the insertion groove 283 and the member coupling portion 235. When the guide plate 230 moves forward or backward, the first and second member side portions 281*a* and 285*a* moves along the respective member coupling portion 235.

Meanwhile, the housing 210 further includes a support jaw 221 for supporting a front end portion and a rear end portion of the first and second contact members 281 and 285. The support jaw 221 may be understood as a constitution of a support frame 220 to be described later. In other words, since the front end portion and the rear end portion of the first and second contact members 281 and 285 interfere with the supporting jaw 221, the forward or rearward movement thereof may be restricted.

When the guide plate 230 is moved forward, a pressing force from the guide plate 230 exerting on the first and second contact members 281 and 285 may be acted by a width of the guide plate 230 in the lateral direction which gradually increases. Due to the pressing force, the first and second contact members 281 and 285 move in the lateral direction.

The housing side portion 213 may include an insertion portion 213*a* in which the contact member 280 is disposed. The first and second contact members 281 and 285 may be respectively inserted into the insertion portion 213*a* and may protrude from the housing side portion 213 when moving in the lateral direction.

In detail, when the guide plate 230 is moved forward, the contact member 280 may linearly move away from the housing side portion 213, so as to protrude from the housing side portion 213. At this time, the first and second contact members 281 and 285 move in a direction away from each other, respectively.

On the other hand, when the guide plate 230 is moved backward, the contact member 280 may linearly move in a direction approaching the housing side portion 213, that is, in a direction to be inserted into the insertion portion 213*a*. At this time, the first and second contact members 281 and 285 move in a direction approaching each other, respectively.

The contact mechanism 200 further includes a support frame 220 provided inside the housing 210 and supporting the contact member 280. The frame 220 may be disposed on an upper side of the housing lower portion 212 and may extend from the housing side portion 213 towards an inside of the housing 210. The support frame 220 may include the support jaw 221 extending from the insertion portion 213*a*.

The support frame 220 is formed with a frame opening portion 223 into which at least a portion of the first and second contact members 281 and 285 are inserted. The first and second contact members 281 and 285 extend into the frame opening portion 223 in the lateral direction and make contact with the guide plate 230.

The contact mechanism 200 further includes a stopper mechanism for preventing movement of the guide plate 230. The stopper mechanism includes an engaging member 257 and a rack 258.

The engaging member 257 may be coupled to the front portion of the guide plate 230. The guide plate 230 is provided with a rotation center portion 253 to which the engaging member 257 is rotatably coupled. The engaging member 257 may have a bar shape and may be elastically coupled to the rotation center portion 253.

The engaging member 257 may be configured by coupling two members. In detail, the engaging member 257 may include a first member 257*a* and a second member 257*b*. The first and second members 257*a* and 257*b* may be vertically coupled to each other.

In addition, the lower portion of the first member 257*a* may be inserted into an insertion port 257*c* of the second member 257*b*. The insertion port 257*c* forms an open upper portion of the second member 257*b*.

The engaging member 257 further includes an insertion spring 257*d* for elastically coupling the first and second members 257*a* and 257*b*. For example, the insertion spring 257*d* may include a compression spring.

The insertion spring 257*d* may be disposed between a lower portion of the first member 257*a* and a spring support portion 257*e* of the second member 257*b*. In other words, an upper-end portion of the insertion spring 257*d* may be coupled to the lower portion of the first member 257*a*, and a lower end portion thereof may be coupled to the spring support portion 257*e*. The spring support portion 257*e* forms a horizontal surface as a support surface formed inside the second member 257*b* and may be positioned below the insertion port 257*c*.

The first member 257*a* and the second member 257*b* are moved toward or away from each other when the engaging member 257 is engaged with the rack 258 or is disengaged from the rack 258. When the first member 257*a* and the second member 257*b* move in a direction approaching each other, the restoring force of the insertion spring 257*d* may be overcome.

The contact mechanism 200 further includes an engaging spring 259 coupling the engaging member 257 to the guide plate 230. For example, the engaging spring 259 may include a torsion spring. The engaging spring 259 may be coupled to a rear surface of the engaging member 257 and a rotation center portion 253 of the guide plate 230.

The rack 258 is provided at a front portion of the housing lower portion 212 and may extend in the front and rear direction. The rack 258 may be positioned below the engaging member 257. When the engaging member 257 is engaged with the rack 258, the movement of the guide plate 230 moving toward the front or rear is restricted, and accordingly, the first and second contact members 281 and 285 may be prevented from moving in the lateral direction and fixed.

The housing 210 further includes a guide rail 219 for guiding movement of the guide plate 230 in the front and rear direction. The guide rails 219 protrude from the housing lower portion 212 and extend in the front and rear direction.

The guide rail 219 may be configured to be inserted into the guide plate 230. In detail, the guide plate 230 is formed with a plate groove 233*a* into which the guide rail 219 is inserted. The plate groove 233*a* may be formed to be recessed in the plate lower portion 233 of the guide plate 230.

Since the guide plate 230 may be moved forward or backward in a state where the guide rail 219 is inserted into the plate groove 233*a*, even if an external force acts on the guide plate 230, a phenomenon in which the guide plate 230 is shaken in the lateral direction may be prevented.

Figure 15A:
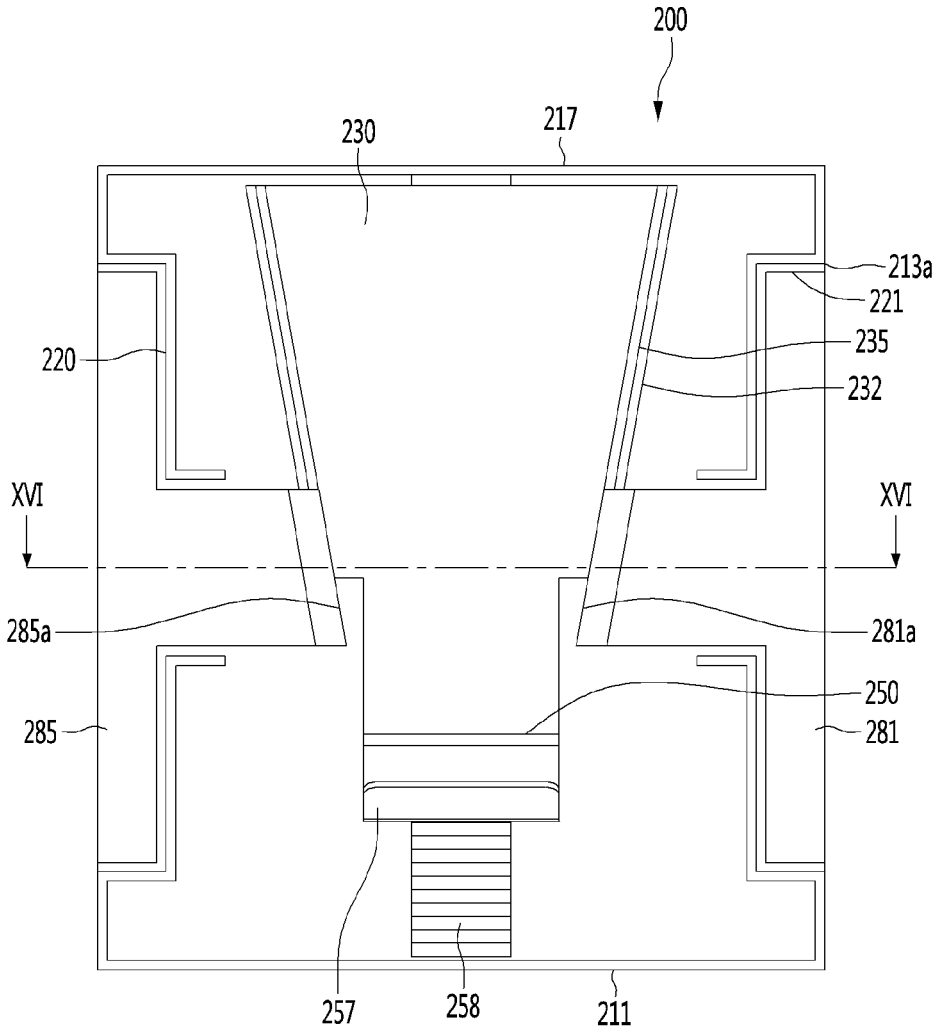
FIGS. 15*a* and 15*b* are views illustrating an operation of the contact mechanism according to the first embodiment of the present invention.
Figure 15B:
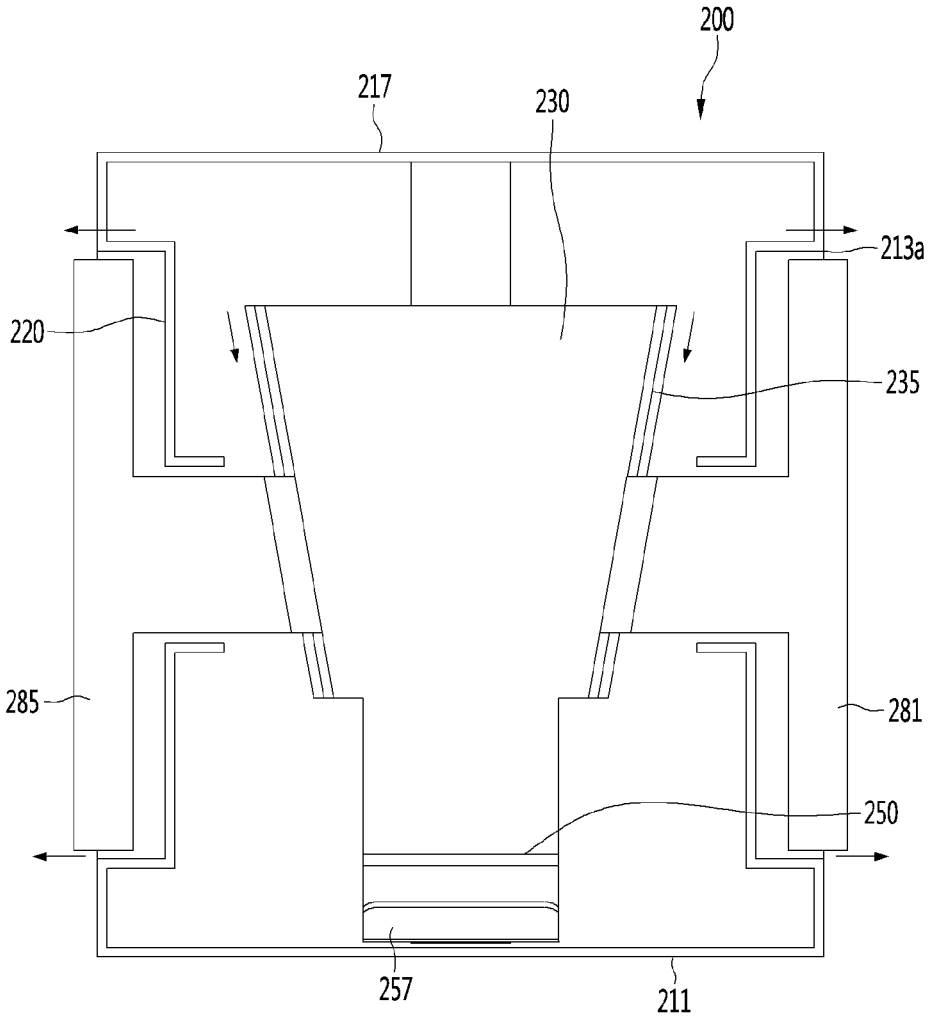
Figure 16:
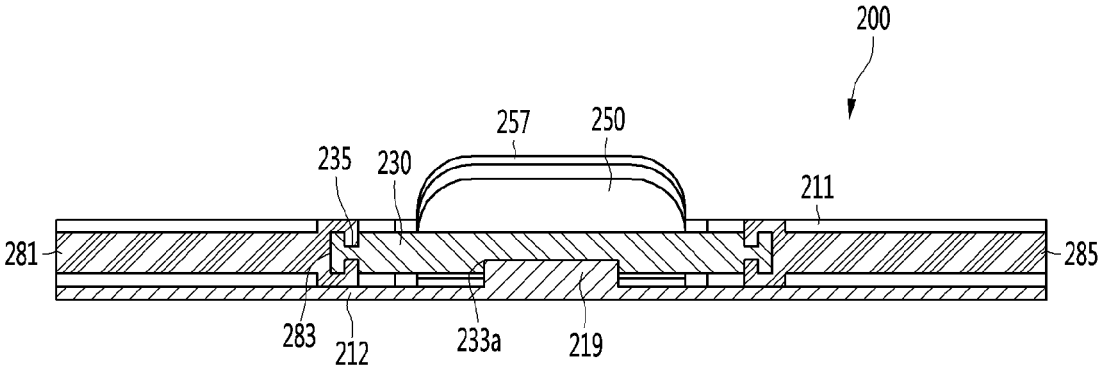
FIG. 16 is a sectional view taken along line XVI-XVI' of FIG. 15*a*.

FIGS. 15*a* and 15*b* are views illustrating an operation of the contact mechanism according to the first embodiment of the present invention, FIG. 16 is a sectional view taken along line XVI-XVI' of FIG. 15*a*, and FIGS. 17*a* to 17*c* are views illustrating an operation of the lever and the engaging member according to the first embodiment of the present invention.

First, when the lever 250 of the refrigerator 10 is not operated, as illustrated in FIG. 15*a*, the lever 250 and the engaging member 257 are positioned at a relatively rearward position in the cutout portion 218 and the guide plate 230 is positioned at a relatively rear position within the housing 210. The first and second contact members 281 and 285 may be inserted in the inserting portion 213*a* to form substantially the same plane as the housing side portion 213, that is, the first and second contact members may be flush with the housing side portion.

Figure 17A:
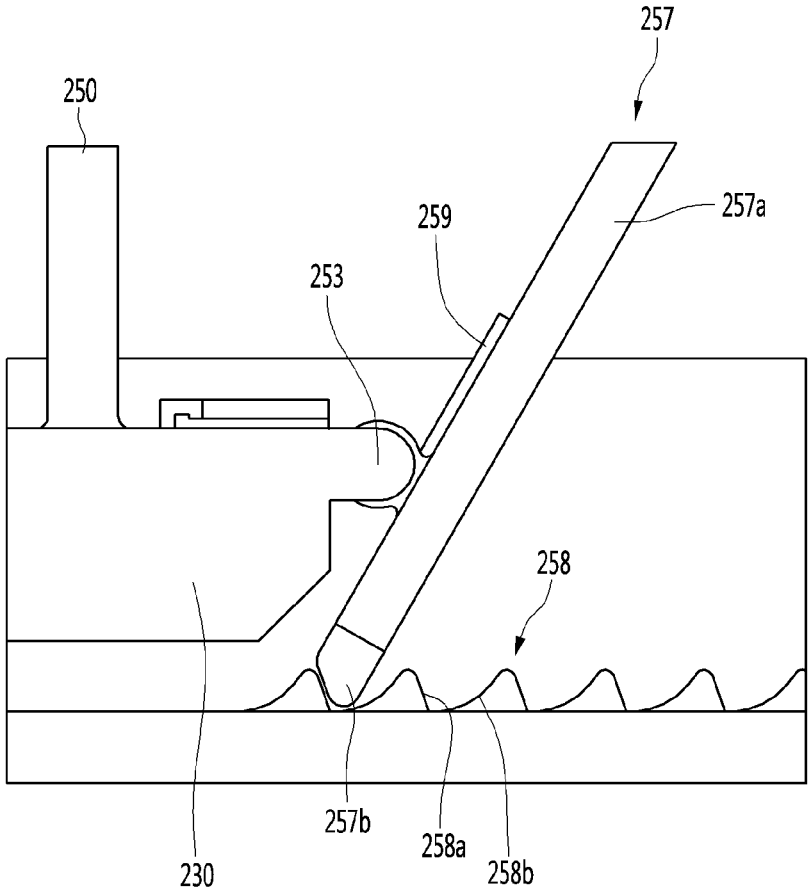
FIGS. 17*a* to 17*c* are views illustrating an operation of a lever and an engaging member according to the first embodiment of the present invention.

In addition, as illustrated in FIG. 17*a*, the engaging member 257 may be in a state of being engaged with the rack 258 below the engaging member 257.

In detail, a restoring force of the engaging spring 259 may be applied to the engaging member 257. Accordingly, the upper portion of the engaging member 257 may be positioned forward of the rotation center portion 253 and the lower portion of the engaging member 257 may be positioned rearward of the rotation center portion 253.

The lower portion of the engaging member 257 may engage with the rack 258. In other words, due to the restoring force of the engaging spring 259, the engaging member 257 receives a force which is rotated in the clockwise direction with respect to the rotation center portion 253.

At this time, the insertion spring 257*d* is tensioned so that the first and second members 257*a* and 257*b* are in a state of being fixed to each other, and the rack 258 may be firmly engaged.

The rack 258 may include a first guide surface 258*a* and a second guide surface 258*b* which extend obliquely with respect to the horizontal plane. The rack 258 may be configured such that the first and second guide surfaces 258*a* are alternately disposed. The lower portion of the engaging member 257 may be engaged between the first guide surface 258*a* and the second guide surface 258*b*.

The first guide surface 258*a* is positioned behind the second guide surface 258*b* and the inclined angle of the first guide surface 258*a* with respect to the horizontal plane may be formed to be larger than the inclined angle with respect to a horizontal plane of the second guide surface 258*b*.

When the engaging member 257 and the rack 258 are in the engaged state, the engaging member 257, in particular, the second member 257*b* is stably engaged with the first guide surface 258*a* by being pressed to the first guide surface 258*a* by the restoring force of the insertion spring 257*d*.

Figure 17B:
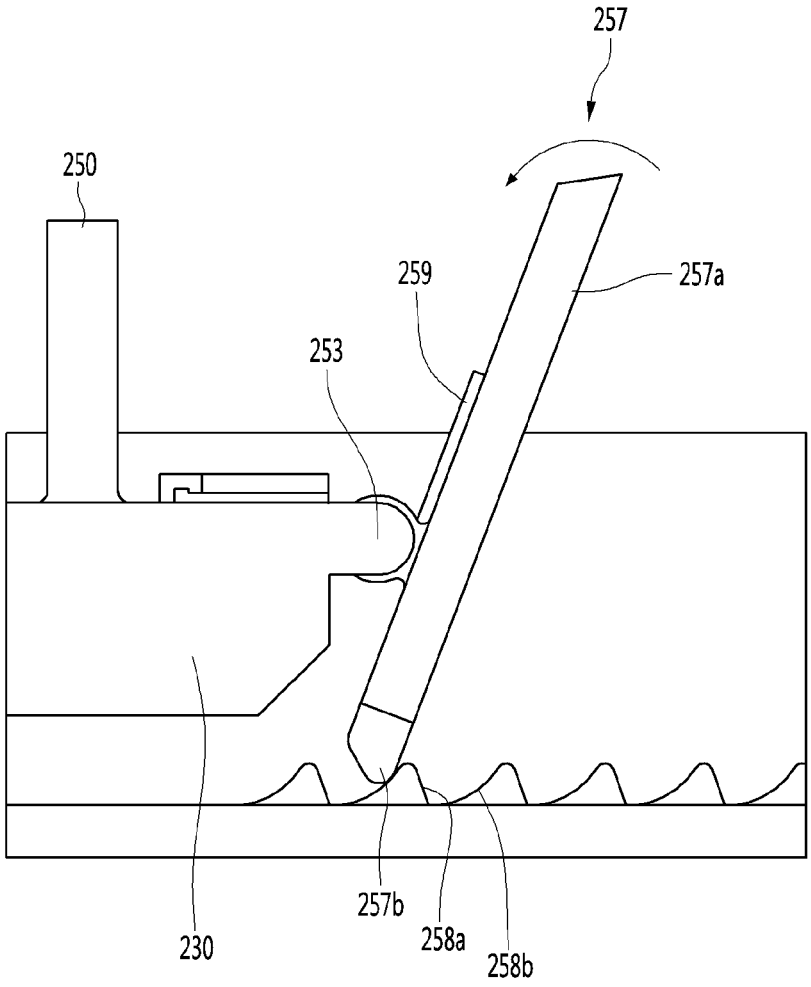

In this state, the engaging state of the engaging member 257 with respect to the rack 258 may be disengaged. In detail, as illustrated in FIG. 17*b*, when the engaging member 257 is rotated in the counterclockwise direction with respect to the rotation center portion 253, the lower portion of the engaging member portion 257, that is, the second member 257*b* may move along the second guide surface 258*b*. At this time, the second member 257*b* overcomes the restoring force of the insertion spring 257*d* and moves upward by a predetermined distance to be smoothly rotated.

Figure 17C:
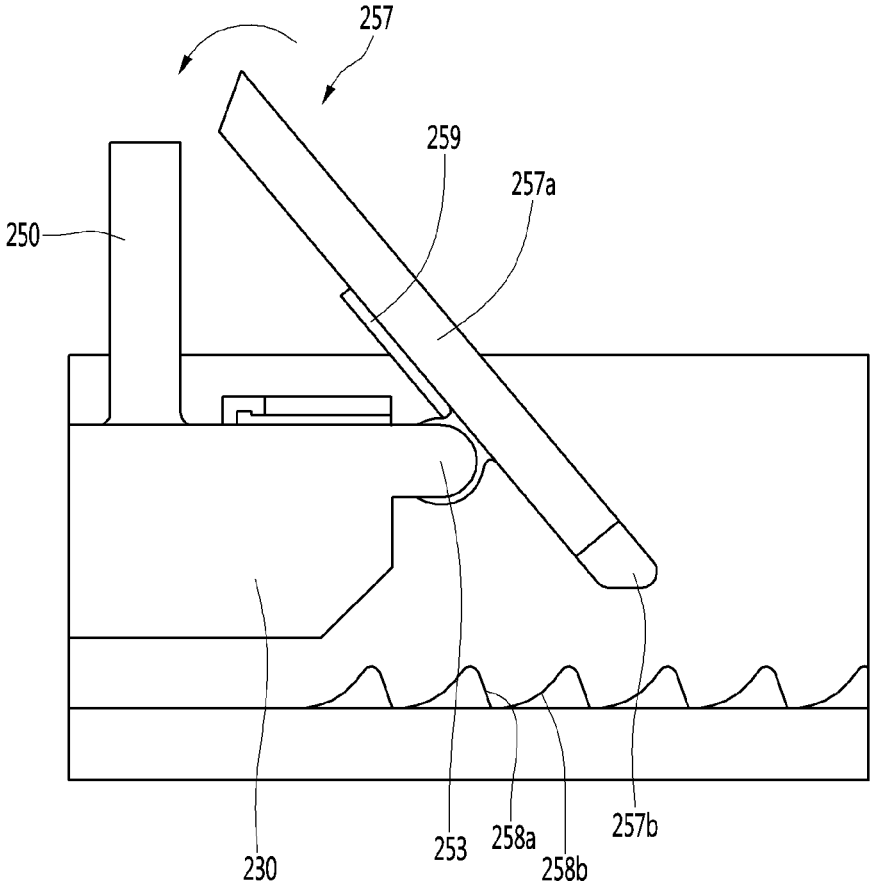

The disengaging action of the engaging member 257 may be performed until the engaging member 257 is completely detached from the rack 258, as illustrated in FIG. 17*c*.

When the engaging member 257 is detached from the rack 258, the lever 250 may be pulled forward. When the lever 250 is moved forward, the guide plate 230 moves forward as illustrated in FIG. 15*b*.

In a process in which the guide plate 230 is moved forward, the inclined surfaces of the plate side portions 232 and the member side portions 281*a* and 285*a* of the first and second contact members 281 and 285 interact with each other, and as a result, a lateral pressing force may be exerted to the first and second contact members 281 and 285.

The first and second contact members 281 and 285 may move in a direction away from the housing 210 and protrude laterally out from the housing side portion 213 due to the pressing force.

Figure 18:
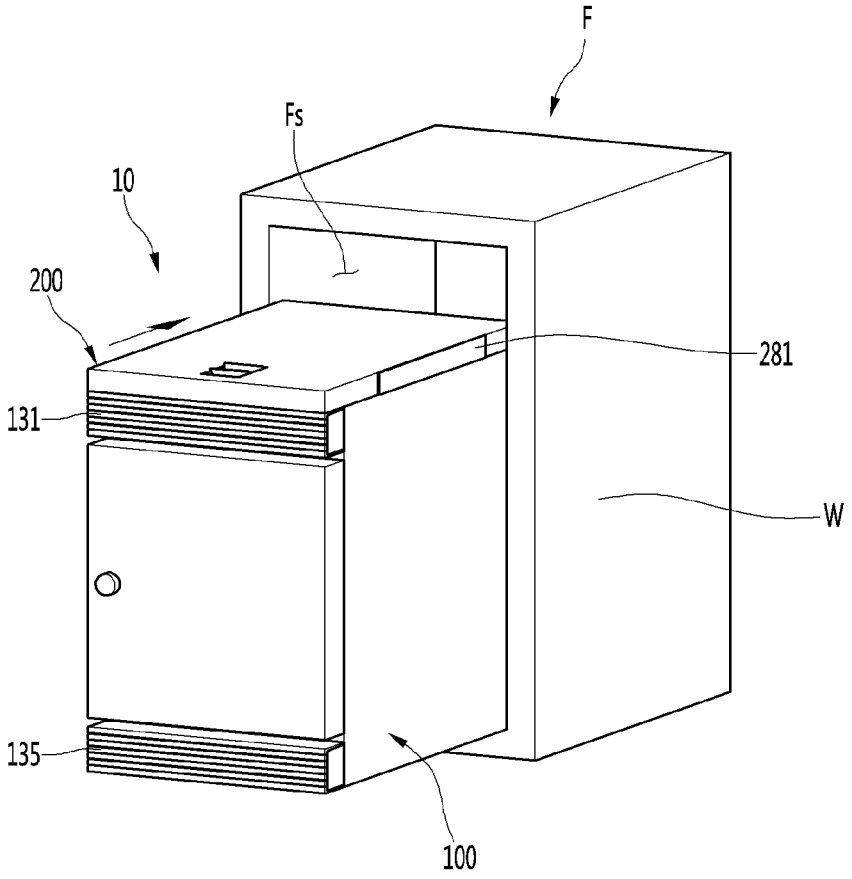
FIG. 18 is a view illustrating a state where the refrigerator according to the first embodiment of the present invention is being housed in a storage space of the furniture.
Figure 19A:
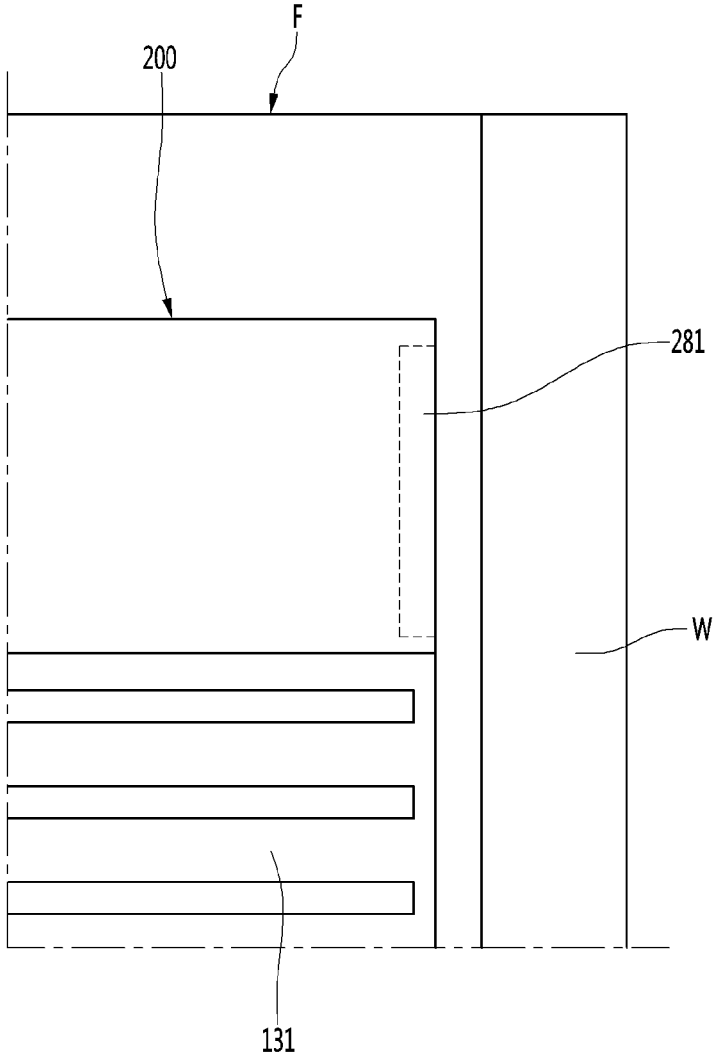
FIGS. 19*a* and 19*b* are views illustrating the operation of the contact member after the refrigerator according to the first embodiment of the present invention is housed in the furniture.
Figure 19B:
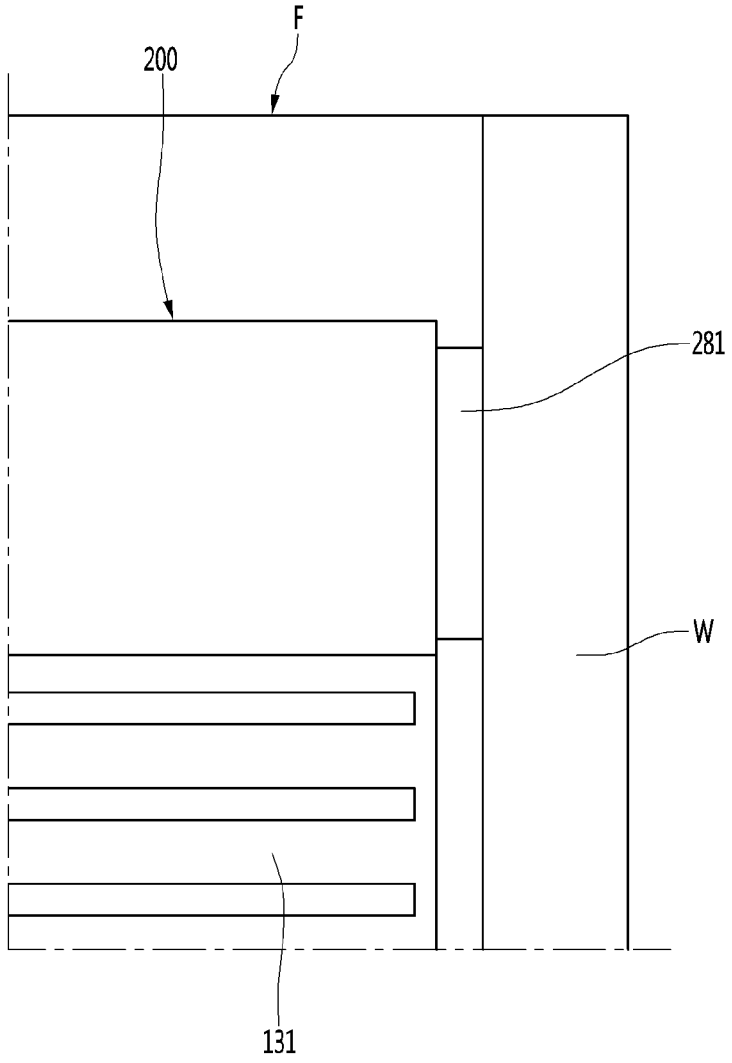

FIG. 18 is a view illustrating a state where the refrigerator according to the first embodiment of the present invention is housed in a storage space of furniture, and FIGS. 19*a* and 19*b* are views illustrating the operation of the contact member after the refrigerator according to the first embodiment of the present invention is housed in the furniture.

Referring to FIG. 18, the user may insert the refrigerator 10 into the storage space Fs of the furniture F. At this time, the engaging member 257 is in a state of being engaged with the rack 258, and the lever 250 and the first and second contact members 281 and 285 may be in a state as illustrated in FIG. 15*a*.

When the refrigerator 10 is housed in the storage space Fs, the first and second contact members 281 and 285 may be in a state of being spaced apart from the wall W of the furniture F by a predetermined distance, as illustrated in FIG. 19*a*.

The user may disengage the engaging member 257 and pull the lever 250 as illustrated in FIGS. 17*b* and 17*c*. As the lever 250 moves forward, the first and second contact members 281 and 285 protrude in a direction protruding from the housing side portion 213, that is, in the lateral direction, and as illustrated in FIG. 19*b*, the first and second contact members 281 and 285 may be in contact with the wall W of the furniture F.

When the operation of the engaging member 257 is stopped, the engaging member 257 may be rotated in the clockwise direction by the restoring force of the engaging spring 259 and may be engaged with the rack 258 (See FIG. 17*a*). If the engaging member 257 is engaged, the front and rear movements of the lever 250 and the guide plate 230 are restricted so that a state where the first and second contact members 281 and 285 protrude from the housing side portion 213 may be maintained.

According to this configuration and operation, the movement of the first and second contact members 281 and 285 may be easily performed by the operation of the lever 250, and the engaging member 257 is engaged to the rack 258, and thus the movement of the lever 250 may be restricted.

As a result, since a state where the first and second contact members 281 and 285 are in contact with each other is effectively maintained, the refrigerator 10 is stably installed in the furniture F in a state of being housed in the storage space Fs, and thus the movement of the refrigerator 10 may be prevented.

Hereinafter, other embodiments of the present invention will be described. These embodiments differ from the first embodiment in the installation position or in a portion of the configuration of the contact mechanism, and thus the differences will be mainly described, and the description and reference numerals of the first embodiment may be used for the same portions as those of the first embodiment.

Figure 20:
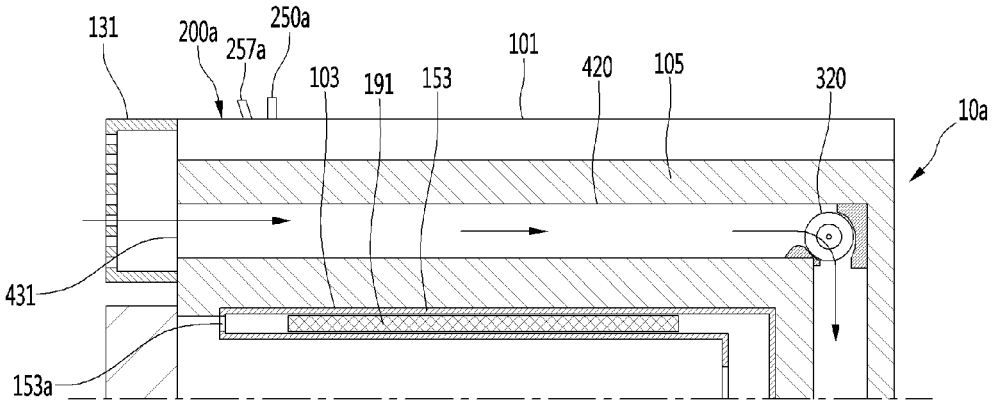
FIG. 20 is a view illustrating a configuration of a refrigerator according to a second embodiment of the present invention.

FIG. 20 is a view illustrating a configuration of a refrigerator according to a second embodiment of the present invention.

Referring to FIG. 20, a refrigerator 10*a* according to a second embodiment of the present invention includes a contact mechanism 200*a* installed inside the outer case 101. In detail, the contact mechanism 200*a* may be positioned between the cabinet insulation material 105 which are disposed on the upper portion of the cabinet 100 and the outer case 101. Therefore, the outer case 101 may configure a housing which is provided in the contact mechanism 200*a*.

A lever 250*a* and an engaging member 257*a* provided on the upper portion of the contact mechanism 200*a* may protrude above the outer case 101. In addition, the description of the configuration of the contact mechanism 200*a* uses the description of the contact mechanism 200 according to the first embodiment.

According to this configuration, since the contact mechanism 200*a* is positioned inside the cabinet 100 of the refrigerator, the outer appearance of the refrigerator product may be more aesthetically pleasing.

Figure 21:
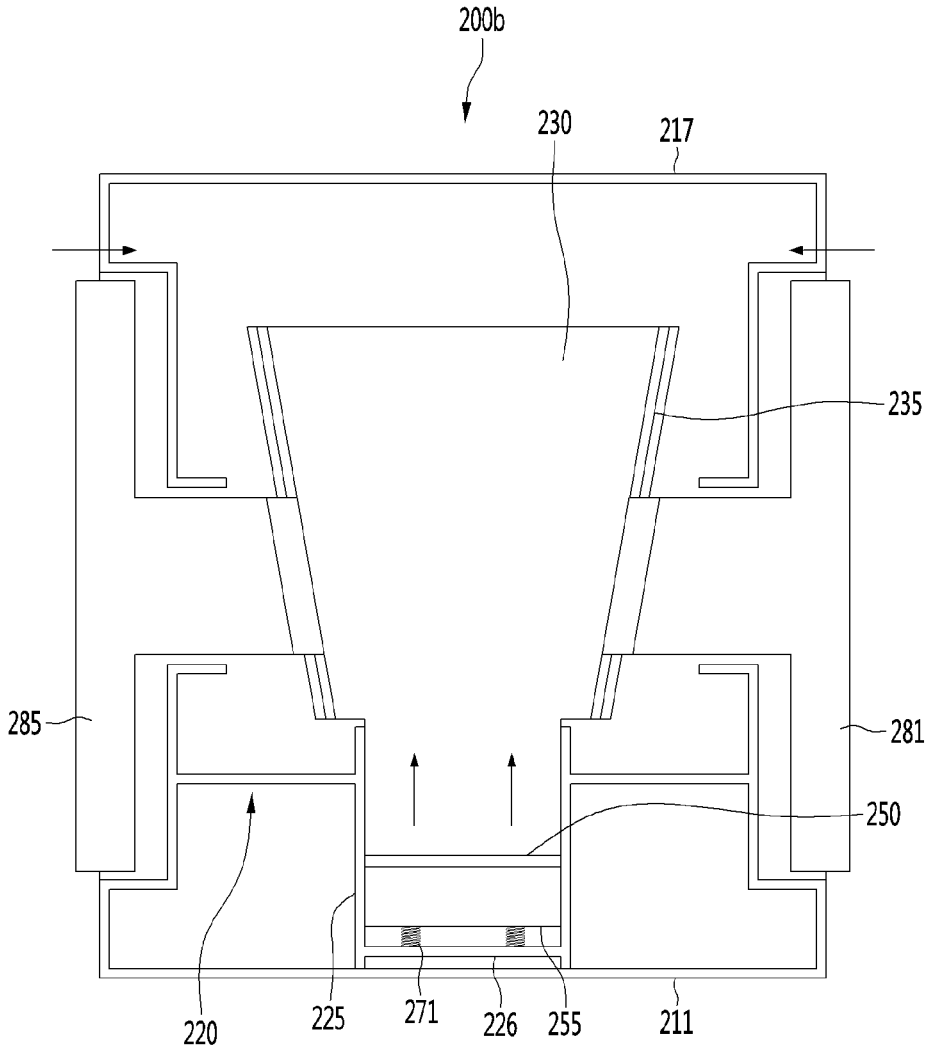
FIGS. 21 and 22 are views illustrating a configuration and operation of a contact mechanism according to a third embodiment of the present invention.
Figure 22:
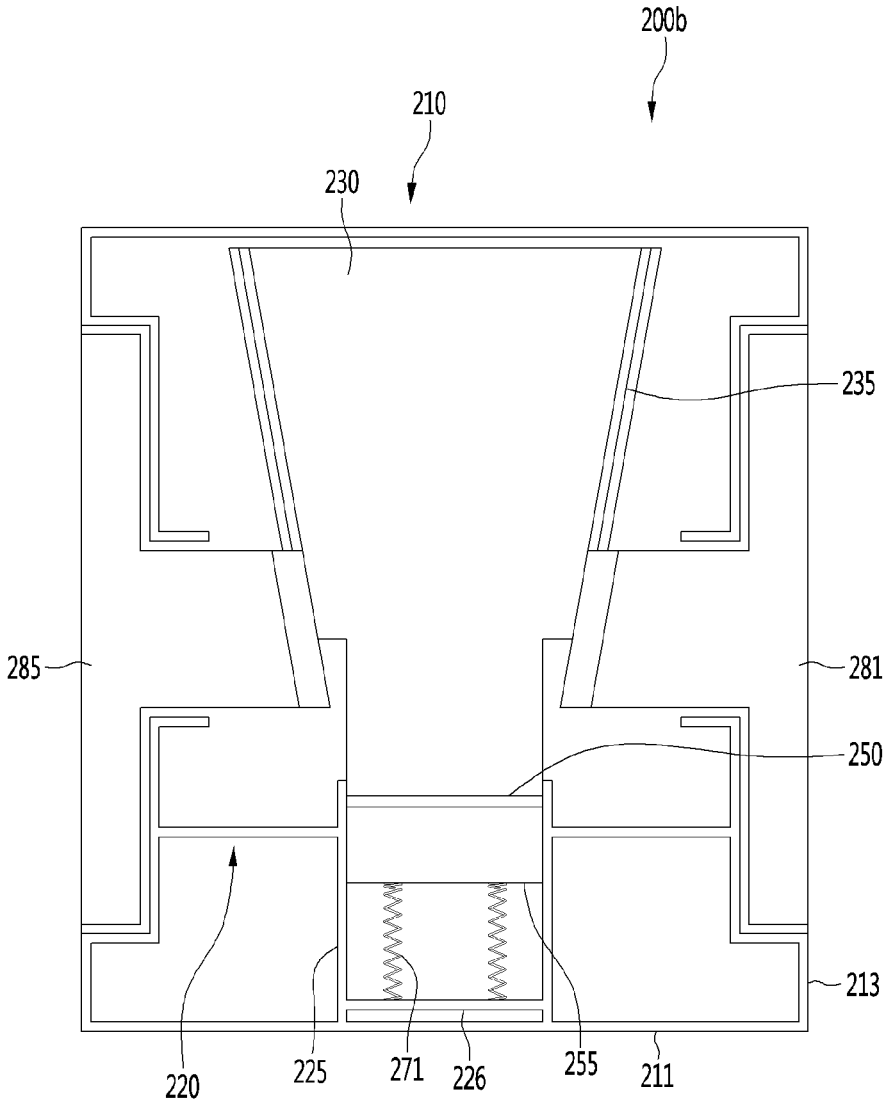

FIGS. 21 and 22 are views illustrating a configuration and operation of a contact mechanism according to a third embodiment of the present invention.

Referring to FIGS. 21 and 22, the frame 220 of the contact mechanism 200*b* according to the third embodiment of the present invention includes two lever supports 225 for supporting both sides of the guide plate 230. The two lever supports 225 are spaced apart from each other and the guide plate 230 may move between the two lever supports 225 in the front and rear direction. In other words, the lever support 225 functions as "a guide rail" of the guide plate 230.

The contact mechanism 200*b* may include a spring mechanism for providing the guide plate 230 with a restoring force. The spring mechanism includes a plate elastic member 271 coupled to a front portion of the guide plate 230. For example, the plate elastic member 271 may include a tension spring.

The plate elastic member 271 may be disposed between a spring coupling portion 255 and a spring support jaw 226. The spring coupling portion 255 is provided at the front end portion of the guide plate 230 and one end portion of the first elastic member 271 may be coupled to the spring coupling portion 255.

The spring support jaw 226 is provided between the two lever supports 225 as one configuration of the frame 220 and may extend in the lateral direction. The other end portion of the plate elastic member 271 may be coupled to the spring support jaw 226.

When the user moves the lever 250 backward, the spring coupling portion 255 may also move backward and the plate elastic member 271 may be tensioned in a state of being supported by the spring support jaw 226.

In addition, by the interaction of the guide plate 230 and the first and second contact members 281 and 285 as the guide plate 230 moves backward, as illustrated in FIG. 22, the first and second contact members 281 and 285 may be linearly moved in a direction approaching each other, that is, in a direction of being inserted into the insertion groove 213*a* of the housing side portion 213.

The first and second member side portions 281*a* and 285*a* of the first and second contact members 281 and 285 are inserted into the member coupling portion 235 and a structure in which the plate side portion 232 is inserted into the insertion groove 283 of the first and second contact members 281 is the same as that described in the first embodiment.

The user may insert the refrigerator 10 into the storage space Fs of the furniture F in the state as illustrated in FIG. 22.

In the state of FIG. 22, when the user stops the operation of the lever 250, the lever 250 and the guide plate 230 move forward due to the restoring force of the plate elastic member 271.

As the guide plate 230 moves forward, as illustrated in FIG. 21, by the interaction of the guide plate 230 and the first and second contact members 281 and 285, the first and second contact members 281 and 285 may move linearly in the lateral outer directions of the housing 210. Thus, the first and second contact members 281 and 285 may come in contact with the wall W of the furniture F.

Figure 23:
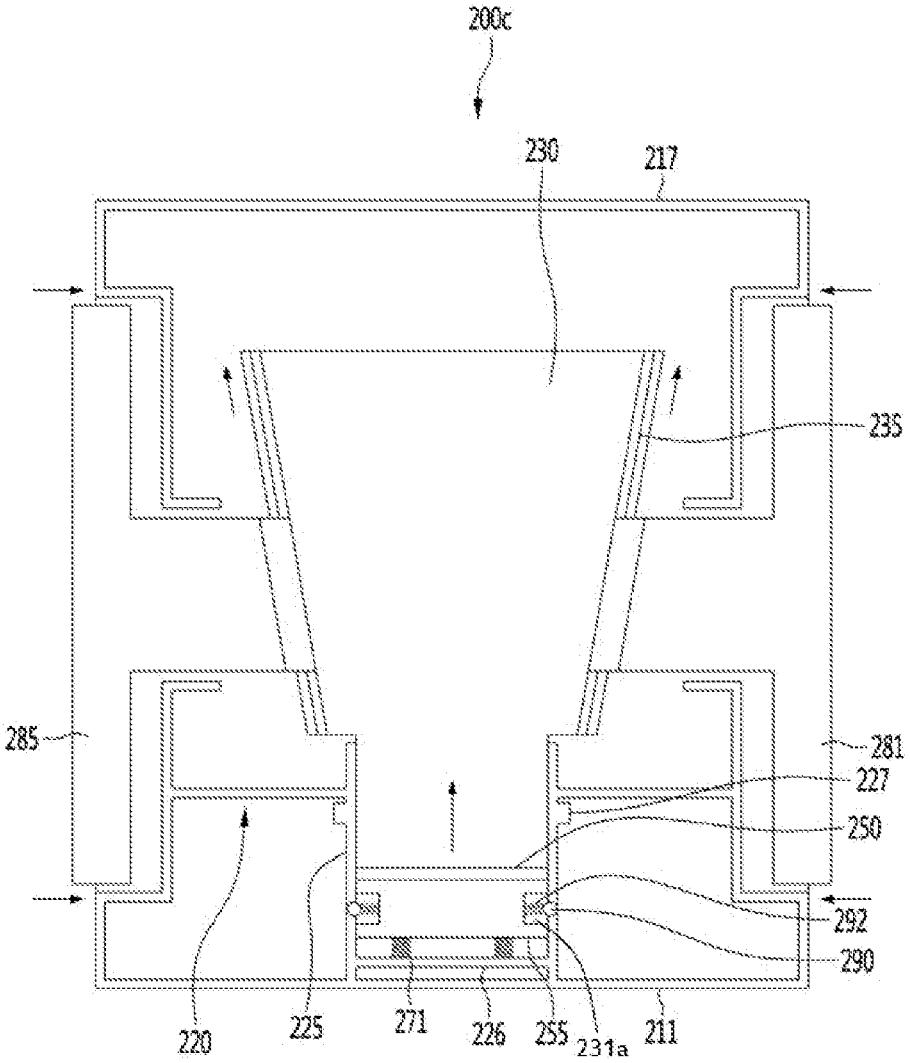
FIGS. 23 and 24 are views illustrating a configuration of a contact mechanism according to a fourth embodiment of the present invention.
Figure 24:
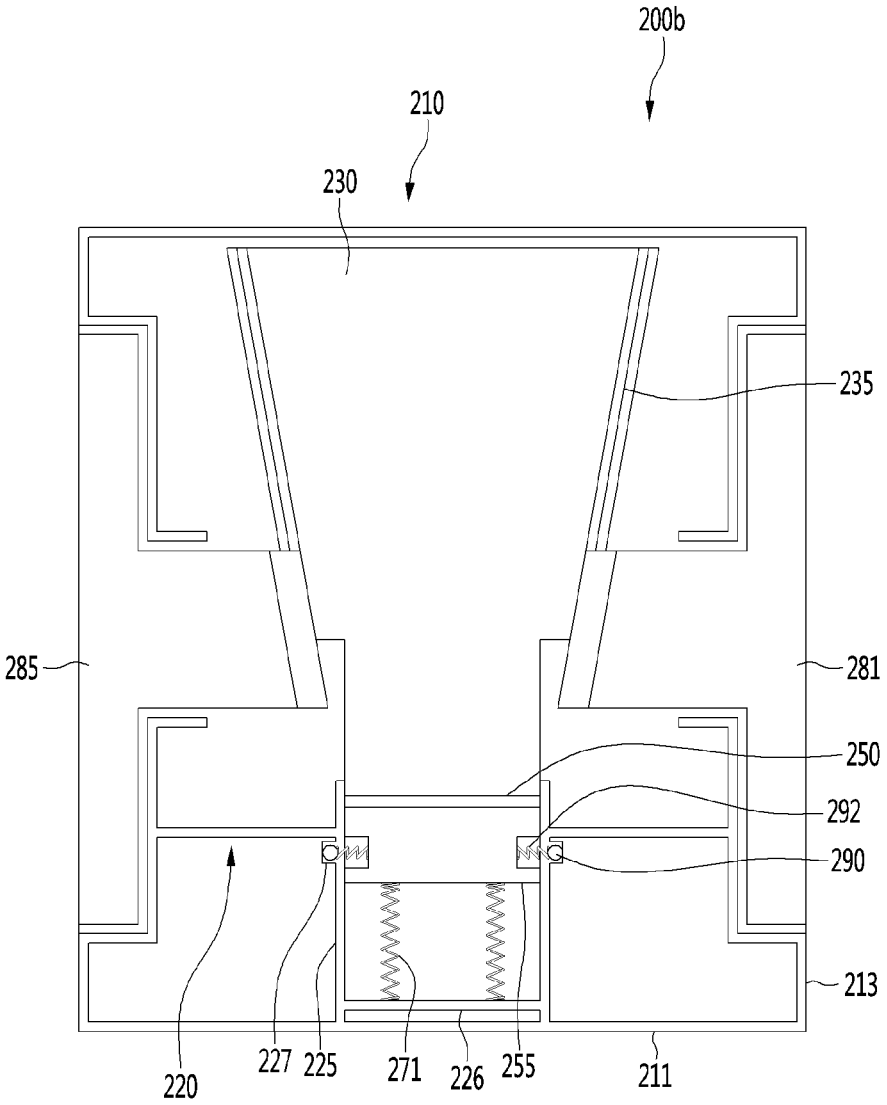

FIGS. 23 and 24 are views illustrating a configuration of a contact mechanism according to a fourth embodiment of the present invention.

Referring to FIGS. 23 and 24, the contact mechanism 200*c* according to the fourth embodiment of the present invention includes a lever 250, a lever support 225 provided on both sides of the lever 250, a spring support jaw 226 connecting both side lever supports 225, and a plate elastic member 271 provided between the lever 250 and the spring support jaw 226. With respect to the description of these configurations, the description related to the third embodiment may be used.

The contact mechanism 200*c* includes the guide plate 230 and the first and second contact members 281 and 285 described in the first embodiment, and the description relating to these configurations may use the description of the first embodiment.

As described in the first embodiment, the lever 250 may be linearly moved forward or backward between the lever supports 225 on both sides thereof.

The guide plate 230 may include stopper mechanisms 290 and 292 for restricting movement of the guide plate 230. The stopper mechanisms 290 and 292 include a ball 290 and a ball spring 292 coupled to the ball 290 to provide a restoring force. For example, the ball spring 292 may include a compression spring.

The guide plate 230 includes an installation groove 231*a* in which the restriction mechanism is installed. The installation groove 231*a* may be configured by recessing a front side surface of the guide plate 230. The ball spring 292 is coupled to the installation groove 231*a* and the ball 290 may be provided so as to protrude from a side surface of the guide plate 230 due to the restoring force of the ball spring 292.

The lever support 225 is formed with an engaging groove 227 into which at least a portion of the ball 290 is inserted. The engaging groove 227 may be positioned behind the installation groove 231*a* in a state where the refrigerator 10 is installed in the storage space Fs of the furniture F.

When the ball 290 is positioned at the side of the engaging groove 227 in a process of moving the guide plate 230 backward, the ball 290 may be engaged in the engaging groove 227.

The operation of the restriction mechanisms 290 and 292 will be briefly described.

FIG. 23 illustrates the positions of the lever 250 and the guide plate 230 when no external force is applied to the lever 250 or the guide plate 230. At this time, the lever 250 may be positioned relatively forward. In other words, the lever 250 may be positioned relatively close to the spring support jaw 226 by the restoring force of the first elastic member 271. The ball 290 is pushed by the lever support 225 and is positioned inside the installation groove 231*a*.

Meanwhile, in a state of FIG. 23, when the user moves the lever 250 rearward, the ball 290 slides rearward along with the lever support 225. The ball 290 protrudes from the side surface of the lever main body 251 and at least a portion of the ball 290 may be inserted into an engaging groove 227 when the ball 290 is positioned on a side of the engaging groove 227 (see FIG. 24).

In a state of FIG. 24, as illustrated in the first embodiment, the first and second contact members 281 and 285 may be drawn into the housing 210 by the action of the guide plate 230 and the first and second contact members 281 and 285. In addition, when the ball 290 is engaged with the engaging groove 227, the guide plate 230 may be restricted from moving forward.

Finally, in a state where the ball 290 is engaged with the engaging groove 227 by moving the lever 250 backward, the user may release the lever 250 and conveniently store the refrigerator 10 in the storage space Fs. In other words, it is not necessary to grasp the lever 250 continuously until the refrigerator 10 is housed.

When the lever 250 is pulled out from the engaged groove 227 by pulling the lever 250 forward in a state where the refrigerator 10 is housed in the storage space Fs, the lever 250 may be moved forward by the restoring force of the plate elastic member 271. In addition, the first and second contact members 281 and 285 protrude from the housing side portion 213 and make contact with the wall W of the furniture F.

FIGS. 25 to 28 are views illustrating a configuration and operation of a refrigerator according to a fifth embodiment of the present invention.

Figure 25:
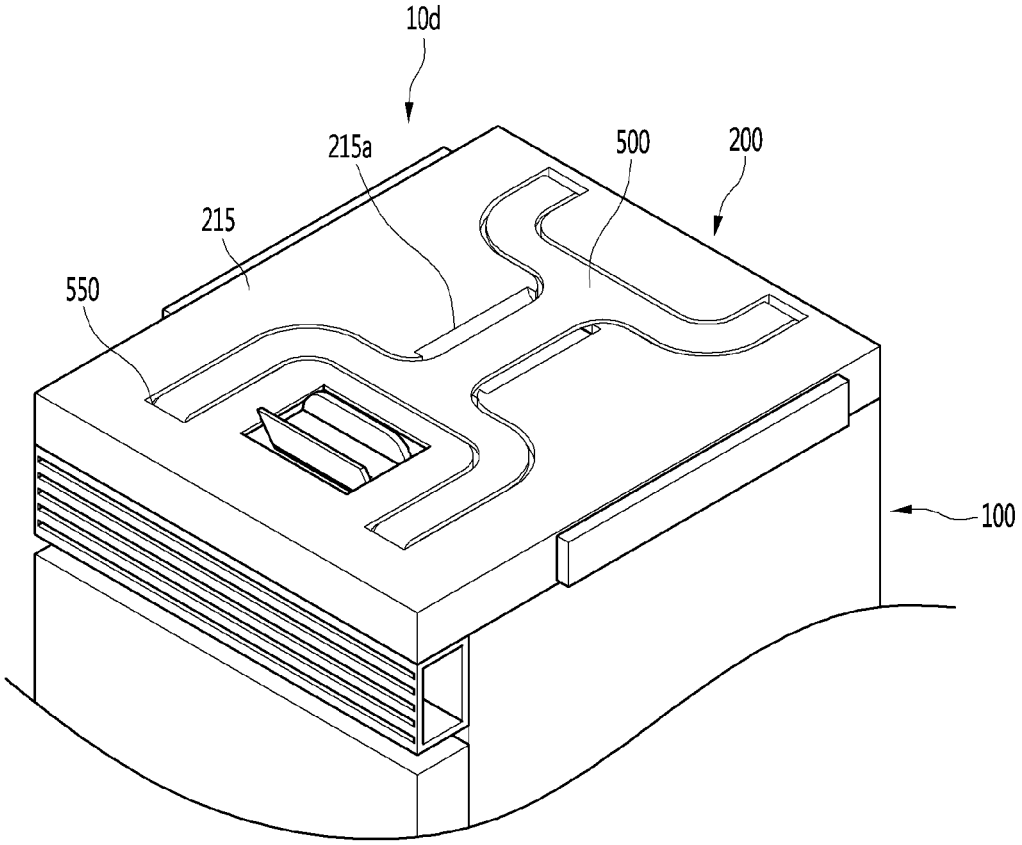
FIGS. 25 to 28 are views illustrating a configuration and operation of a refrigerator according to a fifth embodiment of the present invention.
Figure 26:
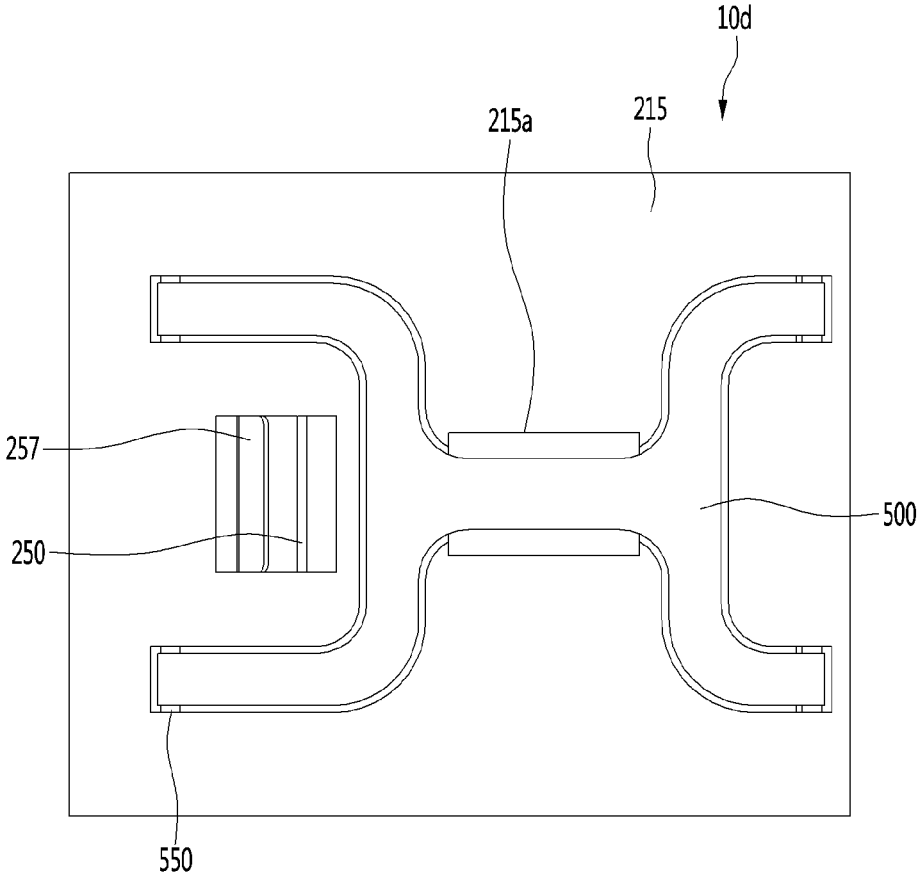
Figure 27:
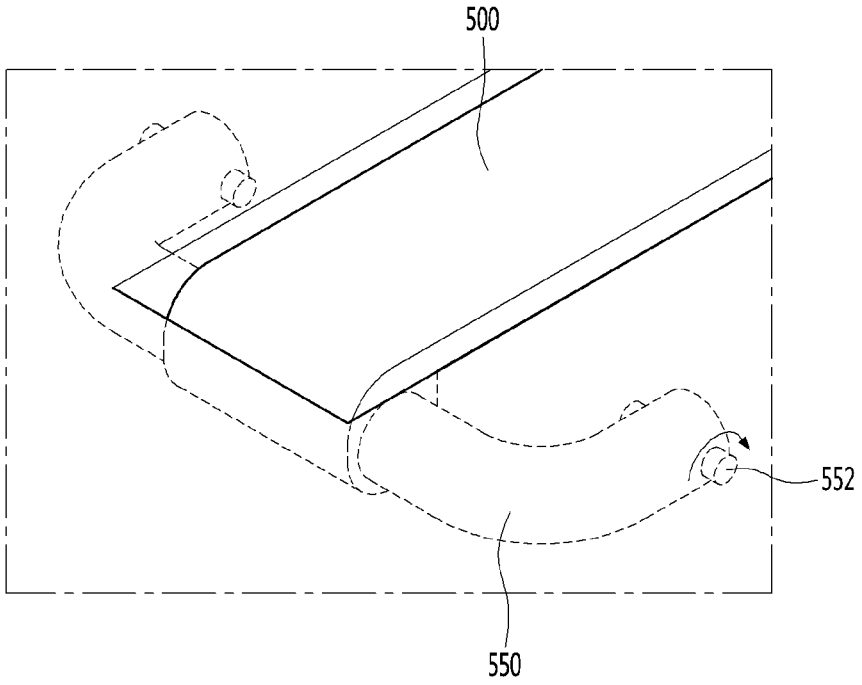
Figure 28:
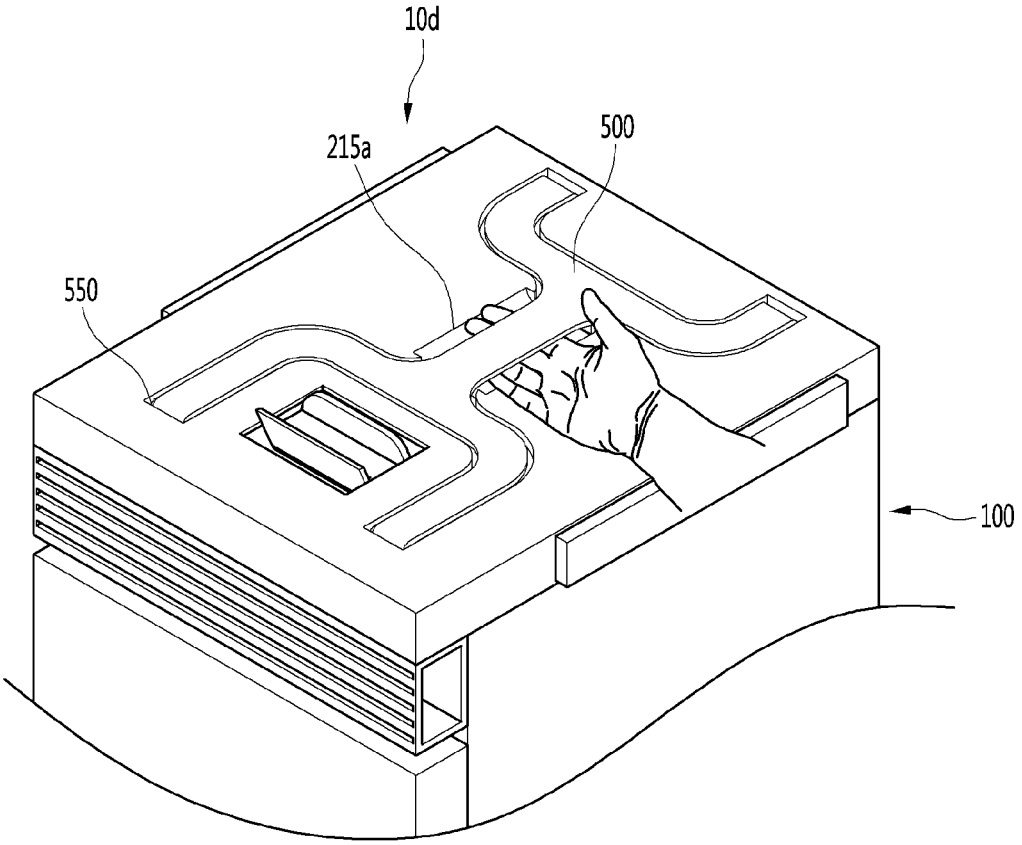

Referring to FIGS. 25 and 28, a refrigerator 10*d* according to the fifth embodiment of the present invention includes a handle 500 which may be grasped to lift the refrigerator by the user. The handle 500 may be provided at an upper portion of the contact mechanism 200.

The handle 500 may be coupled at a plurality of points on a housing upper portion 215. In detail, the handle 500 may be coupled to two front portions and two rear portions of the housing upper portion 215.

A hinge portion 550 may be provided at a portion where the handle 500 is coupled to the housing upper portion 215. In other words, four hinge portions 550 are provided and the hinge portions 550 may be coupled to the front lateral sides and rear lateral sides of the handle 500.

The hinge portion 550 may be rotatably coupled to the housing upper portion 215. In detail, the hinge portion 550 may be configured to have a bent shape, for example, a U shape. A hinge shaft 552 coupled to the housing upper portion 215 may be provided on both sides of the hinge portion 550. The hinge portion 550 may be rotated about the hinge shaft 552.

When the hinge portion 550 rotates about the hinge shaft 552, the handle 500 may be moved upward by a predetermined distance. When the user lifts the handle 500, the four hinge portions 550 rotate to lift the handle 500. In one example, the handle 550 may be constructed of a stretchy leather or rubber material (see FIG. 28).

The housing upper portion 215 is formed with a handle groove 215*a* into which a user's hand or a finger may be inserted. The handle groove 215*a* may be recessed in a substantially central portion of the handle 500. With the configuration of the handle groove 215*a*, the user may easily grasp the refrigerator 10*d*.

What is claimed is:

1. A refrigerator to be installed in a storage space defined by a wall of an object, the refrigerator comprising:

a cabinet including an inner case which forms a storage chamber, an outer case which surrounds the inner case and a cabinet insulation material which is disposed between the inner case and the outer case;

a door disposed in front of the cabinet to open and close the storage chamber;

a supply duct disposed at the inner case, the supply duct to discharge cool air to the storage chamber;

a cool air circulation fan disposed at one side of the supply duct, the cool air circulation fan to generate circulation of the cool air; and a contact mechanism to bring the refrigerator into contact with the wall, the contact mechanism including a contact member and a lever, wherein the lever is provided at a front portion of the upper surface of the cabinet, wherein the contact member moves with the lever, and wherein the lever is movable in forward and backward direction, and the lever provides a lateral movement of the contact member.

2. The refrigerator of claim 1, wherein the contact member is provided at a side surface of the contact mechanism.

3. The refrigerator of claim 1, wherein the contact mechanism protrudes from the outer case of the refrigerator or is disposed inside the outer case.

4. The refrigerator of claim 1, wherein the contact mechanism includes a housing, the housing being provided with a space in which a power transmitting element to transmit a force generated at the lever to the contact member is disposed.

5. The refrigerator of claim 4, wherein the lever is provided at a front portion or an upper portion of the housing.

6. The refrigerator of claim 4, wherein the lever protrudes upward from the housing.

7. The refrigerator of claim 4, wherein a cutout portion is formed at the housing and the lever extends from an inside of the housing toward an outside of the housing through the cutout portion.

8. The refrigerator of claim 7, wherein the lever is movable inside the cutout portion.

9. The refrigerator of claim 1, wherein the contact mechanism includes a stopper mechanism to restrict movement of the lever, and the stopper mechanism includes a ball and a ball spring coupled to the ball to provide a restoring force.

10. The refrigerator of claim 1, wherein the contact mechanism includes an engaging member and a rack, and the lever includes the engaging member engagable with the rack so that when the refrigerator is in contact with the wall, the contact member of the refrigerator in contact with the wall is prevented from moving when the lever is operated.

11. The refrigerator of claim 1, wherein the contact mechanism includes a guide plate having a side surface extending obliquely in a front and rear direction, and the guide plate is movable in forward and backward direction by operation of the lever to provide a lateral movement of the contact member.

12. The refrigerator of claim 1, wherein the supply duct extends from a rear wall of the cabinet toward a side of the door.

13. The refrigerator of claim 1, further comprising a cold storage agent disposed at the supply duct to keep a temperature of the storage chamber low even when the cool air is not supplied through the supply duct.

14. The refrigerator of claim 1, further comprising:

a heat dissipating duct disposed at the cabinet insulation material to introduce or discharge outdoor air; and a heat dissipating fan disposed at one side of the heat dissipating duct to generate a flow of the outdoor air so that the outdoor air is circulated.

15. The refrigerator of claim 14, wherein the heat dissipating duct includes a first inlet and outlet portion and a second inlet and outlet portion to introduce or discharge the outdoor air, and the first inlet and outlet portion is disposed at an upper end portion of the heat dissipating duct and the second inlet and outlet portion is disposed at a lower end portion of the heat dissipating duct.

* * * * *